US008787778B2

(12) United States Patent
Matsumoto et al.

(10) Patent No.: US 8,787,778 B2
(45) Date of Patent: Jul. 22, 2014

(54) REPLACEMENT TONER CARTRIDGE MANAGEMENT APPARATUS, REPLACEMENT TONER CARTRIDGE MANAGEMENT SYSTEM, IMAGE FORMING APPARATUS, REPLACEMENT TONER CARTRIDGE MANAGEMENT METHOD, AND RECORDING MEDIUM

(75) Inventors: Hideki Matsumoto, Toyokawa (JP); Atsushi Kawai, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 111 days.

(21) Appl. No.: 13/184,029

(22) Filed: Jul. 15, 2011

(65) Prior Publication Data

US 2012/0014700 A1 Jan. 19, 2012

(30) Foreign Application Priority Data

Jul. 16, 2010 (JP) ..... 2010-162322

(51) Int. Cl.
*G03G 15/00* (2006.01)
*G03G 15/08* (2006.01)

(52) U.S. Cl.
USPC ..... 399/12; 399/27

(58) Field of Classification Search
USPC ..... 399/24, 25
See application file for complete search history.

(56) References Cited

U.S. PATENT DOCUMENTS

| | | | | |
|---|---|---|---|---|
| 6,798,995 | B2 | 9/2004 | Nagata | |
| 7,657,193 | B2 * | 2/2010 | Wada | 399/26 |
| 2002/0071133 | A1 * | 6/2002 | Haines | 358/1.13 |
| 2002/0159777 | A1 | 10/2002 | Nagata | |

FOREIGN PATENT DOCUMENTS

| | | | | |
|---|---|---|---|---|
| JP | 09-190068 A | | 7/1997 | |
| JP | H09-190068 A | * | 7/1997 | G03G 15/08 |
| JP | 2002-297969 A | | 10/2002 | |
| JP | 2008-271231 A | | 11/2008 | |

OTHER PUBLICATIONS

Office Action (Notification of Reasons for Refusal) dated May 22, 2012, issued in corresponding Japanese Patent Application No. 2010-162322, and an English Translation thereof. (6 pages).

* cited by examiner

*Primary Examiner* — Clayton E Laballe
*Assistant Examiner* — Jas Sanghera
(74) *Attorney, Agent, or Firm* — Buchanan Ingersoll & Rooney PC

(57) ABSTRACT

A replacement toner cartridge management apparatus is provided with: a receiver which receives toner cartridge replacement information indicating a toner cartridge loaded on one or more than one image forming apparatus which the replacement toner cartridge management apparatus can access via a communication circuit has been replaced or needs to be replaced with a new one; a life information obtainer which obtains the life information of a consumable unit other than the toner cartridge causing the toner cartridge replacement information received by the receiver, a replacement consumable unit for which will be delivered to the same delivery address as a replacement toner cartridge for the toner cartridge causing the toner cartridge replacement information; a determiner which determines a right type of replacement toner cartridge for the toner cartridge causing the toner cartridge replacement information, based on the life information obtained by the life information obtainer; and a transmitter which outputs an instruction to deliver the right type of replacement toner cartridge determined by the determiner.

21 Claims, 15 Drawing Sheets

| Remaining Toner Information | Permit/ Prohibit Printing | Panel Display | Toner State |
|---|---|---|---|
| Normal | Permit printing | (No message displayed) | The sub-hopper and the toner cartridge hold enough toner. |
| Toner Near Empty | Permit printing | One-line message: "There will be a need for toner cartridge replacement in a short time." | The sub-hopper holds some toner but the toner cartridge nearly runs out of toner. |
| Toner Empty (permit printing) | Permit printing | One-line message: "The toner cartridge is running out of toner. Please replace." | The sub-hopper holds some toner but the toner cartridge absolutely runs out of toner. |
| Toner Empty (prohibit printing) | Prohibit printing | Strong Alert message: "The toner cartridge has run out of toner. Please immediately replace and close the toner garage door." | The sub-hopper and the toner cartridge absolutely run out of toner, and printing is not available any more due to low toner concentration. |

FIG.10

| Coverage | First Predetermined Value | Second Predetermined Value |
|---|---|---|
| 75% or higher | 603K (printed pages) | 608K (printed pages) |
| 24% or lower | 597K (printed pages) | 601K (printed pages) |

FIG.15

| Transfer Belt | Fuser Unit | Right Type of Toner Cartridge |
|---|---|---|
| No exceed a first predetermined value | No exceed a first predetermined value | Large-capacity toner cartridge |
| No exceed a first predetermined value | Exceed a second predetermined value | Large-capacity toner cartridge |
| No exceed a first predetermined value | No exceed a second predetermined value | Large-capacity toner cartridge |
| Exceed a second predetermined value | No exceed a first predetermined value | Large-capacity toner cartridge |
| Exceed a second predetermined value | Exceed a second predetermined value | N/A |
| Exceed a second predetermined value | No exceed a second predetermined value | Small-capacity toner cartridge |
| No exceed a second predetermined value | No exceed a first predetermined value | Large-capacity toner cartridge |
| No exceed a second predetermined value | Exceed a second predetermined value | Small-capacity toner cartridge |
| No exceed a second predetermined value | No exceed a second predetermined value | Small-capacity toner cartridge |

FIG. 17

REPLACEMENT TONER CARTRIDGE MANAGEMENT APPARATUS, REPLACEMENT TONER CARTRIDGE MANAGEMENT SYSTEM, IMAGE FORMING APPARATUS, REPLACEMENT TONER CARTRIDGE MANAGEMENT METHOD, AND RECORDING MEDIUM

This application claims priority under 35 U.S.C. §119 to Japanese Patent Application No. 2010-162322 filed on Jul. 16, 2010, the entire disclosure of which is incorporated herein by reference in its entirety.

BACKGROUND OF THE INVENTION

1. Field of the Invention

The present invention relates to a replacement toner cartridge management apparatus which determines a right type of replacement toner cartridge based on the age of another consumable unit when there is a need to replace a toner cartridge loaded on an image forming apparatus or there will be such a need in a short time; a replacement toner cartridge management system employing the replacement toner cartridge management apparatus; an image forming apparatus employed in the replacement toner cartridge management system; a replacement toner cartridge management method; a recording medium having a replacement toner cartridge management program stored thereon to make a computer of the replacement toner cartridge management apparatus implement the replacement toner cartridge management method; and a recording medium having a replacement toner cartridge management program stored thereon to make a computer of the image forming apparatus implement the replacement toner cartridge management method.

2. Description of the Related Art

The following description sets forth the inventor's knowledge of related art and problems therein and should not be construed as an admission of knowledge in the prior art.

Conventionally, if the remaining consumable resource in a consumable unit loaded on an image forming apparatus such as a digital photo copier, a digital photo printer, or a multi-functional machine called MFP (Multi Function Peripheral), for example, the remaining toner in a toner cartridge is lower than a predetermined level, the image forming apparatus determines that the toner cartridge nearly runs out of toner (the toner cartridge is in toner near empty state) and displays for the user a message stating that the toner cartridge nearly runs out of toner, on a display panel provided thereon. Noticing this message, the user prepares a replacement toner cartridge, or places an order for a replacement toner cartridge if not having any ones in stock.

Meanwhile, in recent years, an image forming apparatus connected with a management apparatus to exchange information with has been more commonly used in a remote management system (for example, Japanese Unexamined Patent Publication No. 2002-297969). In many cases, a retailer of image forming apparatuses or a provider of office supplies have their own management apparatus in their own place, in order to collect, store, and manage for their business, various types of information including toner near empty information from a plurality of image forming apparatuses in their users' places. Being connected with the image forming apparatuses, the management apparatus is capable of recognizing that the toner cartridges nearly run out toner and that these are replaced with new ones.

In some cases, the management apparatus is further connected with an order receiving apparatus receiving orders for a replacement toner cartridge (for example, Japanese Unexamined Patent Publication No. 2008-271231). In such a case, the management apparatus further transmits an order to the order receiving apparatus, so that a replacement toner cartridge will be delivered to the user. In other words, this is exactly a system to automatically deliver a replacement toner cartridge to users while they need not bother to place an order for it.

Such an automatic order and delivery system is very useful if the manufacturer and the user are in an agreement about billing and payment for the use of an image forming apparatus. In accordance with such an agreement, the user pay a service fee for making one copy, which includes a charge for the toner used for the copy. That is, it is convenient for the user to pay a service fee simply depending on the number of copies regardless of how many replacement toner cartridges they ordered and have a replacement toner cartridge automatically delivered without the need for placing an order for it. At the same time, the manufacturer can expect a benefit from saving the costs of handling order transactions.

However, while acquiring a benefit from saving the costs of the labor to handle order transactions, the manufacturer still pay the costs of delivering a replacement toner cartridge, using an automatic order and delivery system in which a management apparatus automatically places an order for it based on a condition about remaining toner level (for example, toner near empty information or toner cartridge replacement information).

For example, randomly receiving toner near empty information and end-of-life information one after another from four toner cartridges and other consumable units loaded on one full-color image forming apparatus, respectively, the management apparatus automatically outputs a delivery instruction again and again.

Service persons usually visit the users' places with a replacement consumable unit for replacement service when any of the consumable units nearly reaches the end of life, because they often have difficulties in replacing consumable units other than the toner cartridges. If the service persons also could carry a necessary replacement toner cartridge at the same time, the manufacturer can save the costs of delivery as well. Or alternatively, if a replacement toner cartridge and a replacement consumable unit could be delivered in one package via an outsourced service, the manufacturer also can save the costs of delivery as well.

Despite the actual need for cost-saving, the conventional technologies described in Japanese Unexamined Patent Publications No. 2002-297969 and No. 2008-271231 and the other conventional technologies in which a management apparatus manages toner cartridges loaded on image forming apparatuses and outputs a delivery instruction do not contribute to the saving on delivery costs.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

According to a first aspect of the present invention, a replacement toner cartridge management apparatus is provided with:

a receiver which receives toner cartridge replacement information indicating a toner cartridge loaded on one or more than one image forming apparatus which the replacement toner cartridge management apparatus can access via a communication circuit has been replaced or needs to be replaced with a new one;

a life information obtainer which obtains the life information of a consumable unit other than the toner cartridge causing the toner cartridge replacement information received by the receiver, a replacement consumable unit for which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer; and a transmitter which outputs an instruction to deliver the right type of replacement toner cartridge determined by the determiner.

According to a second aspect of the present invention, a replacement toner cartridge management system is provided with a replacement toner cartridge management apparatus and one or more than one image forming apparatus having one or more than one toner cartridge and one or more than one other consumable unit loaded thereon, which can access each other via a communication network, wherein:

the image forming apparatus is provided with a transmitter which transmits toner cartridge replacement information indicating the toner cartridge has been replaced or needs to be replaced with a new one; and the replacement toner cartridge management apparatus is provided with:

a receiver which receives the toner cartridge replacement information;

a life information obtainer which obtains the life information of any of the consumable units other than the toner cartridge causing the toner cartridge replacement information received by the receiver, a replacement consumable unit for which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer; and a transmitter which outputs an instruction to deliver the right type of replacement toner cartridge determined by the determiner.

According to a third aspect of the present invention, an image forming apparatus is provided with:

a receiver which receives toner cartridge replacement information indicating that a toner cartridge loaded on the image forming apparatus or on a different image forming apparatus which the image forming apparatus can access via a communication circuit has been replaced or needs to be replaced with a new one;

a life information obtainer which obtains the life information of a consumable unit other than the toner cartridge causing the toner cartridge replacement information received by the receiver, a replacement consumable unit for which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer; and a transmitter which outputs an instruction to deliver the right type of replacement toner cartridge determined by the determiner.

According to a fourth aspect of the present invention, a replacement toner cartridge management method implemented by a replacement toner cartridge management system provided with a replacement toner cartridge management apparatus and one or more than one image forming apparatus having one or more than one toner cartridge and one or more than one other consumable unit loaded thereon, which can access each other via a communication network, includes:

the image forming apparatus's transmitting toner cartridge replacement information indicating the toner cartridge has been replaced or needs to be replaced with a new one; and the replacement toner cartridge management apparatus's:

receiving the toner cartridge replacement information;

obtaining the life information of any of the consumable units other than the toner cartridge causing the received toner cartridge replacement information, a replacement consumable unit for which will be delivered to the same delivery address as a replacement toner cartridge for the toner cartridge causing the toner cartridge replacement information;

determining a right type of replacement toner cartridge for the toner cartridge causing the toner cartridge replacement information, based on the obtained life information; and outputting an instruction to deliver the right type of replacement toner cartridge.

According to a fifth aspect of the present invention, a non-transitory computer-readable recording medium having a replacement toner cartridge management program stored thereon to make a computer of a replacement toner cartridge management apparatus execute:

receiving toner cartridge replacement information indicating a toner cartridge loaded on one or more than one image forming apparatus which the replacement toner cartridge management apparatus can access via a communication circuit has been replaced or needs to be replaced with a new one;

obtaining the life information of a consumable unit other than the toner cartridge causing the received toner cartridge replacement information, a replacement consumable unit for which will be delivered to the same delivery address as a replacement toner cartridge for the toner cartridge causing the toner cartridge replacement information;

determining a right type of replacement toner cartridge for the toner cartridge causing the toner cartridge replacement information, based on the obtained life information; and outputting an instruction to deliver the right type of replacement toner cartridge.

According to a sixth aspect of the present invention, a non-transitory computer-readable recording medium having a replacement toner cartridge management program stored thereon to make a computer of an image forming apparatus execute:

receiving toner cartridge replacement information indicating a toner cartridge loaded on one or more than one image forming apparatus which the replacement toner cartridge management apparatus can access via a communication circuit has been replaced or needs to be replaced with a new one;

obtaining the life information of a consumable unit other than the toner cartridge causing the received toner cartridge replacement information, a replacement consumable unit for which will be delivered to the same delivery address as a replacement toner cartridge for the toner cartridge causing the toner cartridge replacement information;

determining a right type of replacement toner cartridge for the toner cartridge causing the toner cartridge replacement information, based on the obtained life information; and outputting an instruction to deliver the right type of replacement toner cartridge.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which:

FIG. 10 is a table illustrating the statuses depending on remaining toner level;

FIG. 15 is a chart serving to correct a first predetermined value and a second predetermined value based on a coverage;

FIG. 17 is a table illustrating the right types of replacement toner cartridge depending on the life information of the transfer belt unit and the fuser unit.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Hereinafter, one mode of implementing the present invention will be described with reference to the accompanying drawings.

Figure 1:
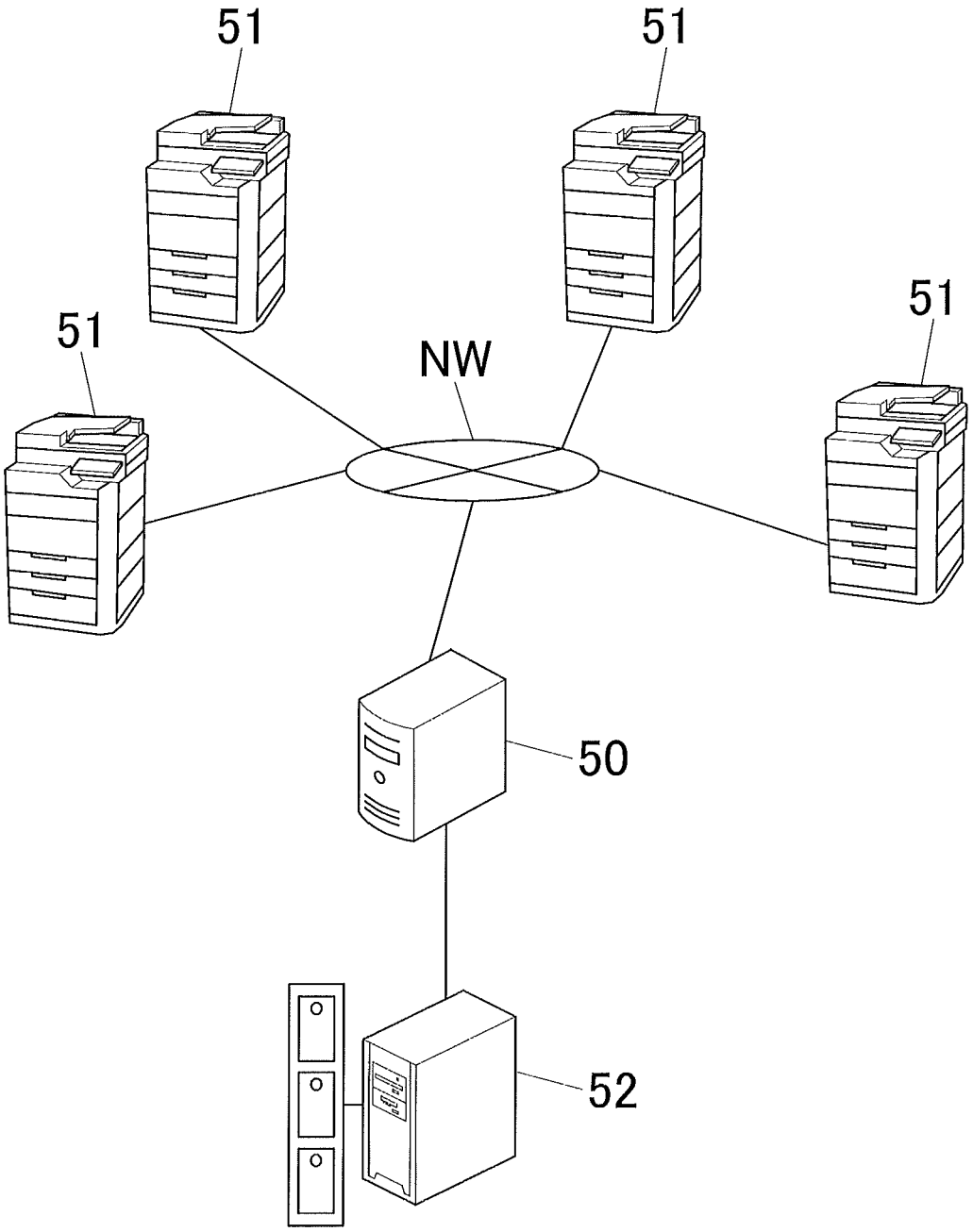
FIG. 1 is a view illustrating a configuration of a replacement toner cartridge management system according to one mode of implementing the present invention.

FIG. 1 is a view schematically illustrating a configuration of a replacement toner cartridge management system according to one mode of implementing the present invention.

As illustrated in FIG. 1, this management system is basically provided with one or more than one image forming apparatus 51 and a management server 50, which are connected to each other via a communication circuit such as Internet. The management server 50 is further connected to an order receiving server 52 via Internet or the like.

The management server 50 is ordinarily provided in a service center or the like taking care of the image forming apparatuses 51 to manage information of the image forming apparatuses 51 by user accounts. More specifically, by communicating with the image forming apparatuses 51, the management server 50 monitors the remaining toner level(s) of a single toner cartridge or plural toner cartridges containing one color or different colors of toner that is a consumable resource, loaded on each of the image forming apparatuses 51, and if there is a replacement toner cartridge(s) for the toner cartridge(s) in stock. That will be further described in detail later. The image management server 50 further manages billing transactions and maintenance issues by collecting billing information such as number of prints and trouble information from the image forming apparatuses 51.

Users may use different types of image forming apparatuses; the image forming apparatuses 51 may be of different types. For example, the image forming apparatuses 51 may be printers, full-color copiers, monochrome copiers, and the like. Therefore, the image forming apparatuses 51 may load four toner cartridges containing four colors of toner: yellow (Y), magenta (M), cyan (C), and black (K), or only one toner cartridge containing one color of toner, black (K).

Furthermore, by monitoring unique uses and use patterns of the users, the management server 50 remotely controls the image forming apparatuses 51 for perfect performance based on settings and the like of the image forming apparatuses 51 stored on its own recording medium. The setting information of the image forming apparatuses 51 is integrally managed by the management server 50; it therefore can be changed by the management server 50 quite easily even if any of the image forming apparatuses 51 are located in remote areas.

The image forming apparatuses 51 and the management server 50 exchange information with each other, for example by e-mails via Internet.

Being further connected to the order receiving server 52, the management server 50 transmits an order for a replacement toner cartridge to the order receiving server 52 according to information indicating a need of toner cartridge replacement received from the image forming apparatuses 51, so that the order receiving server 52 can arrange for an automatic delivery.

Figure 2:
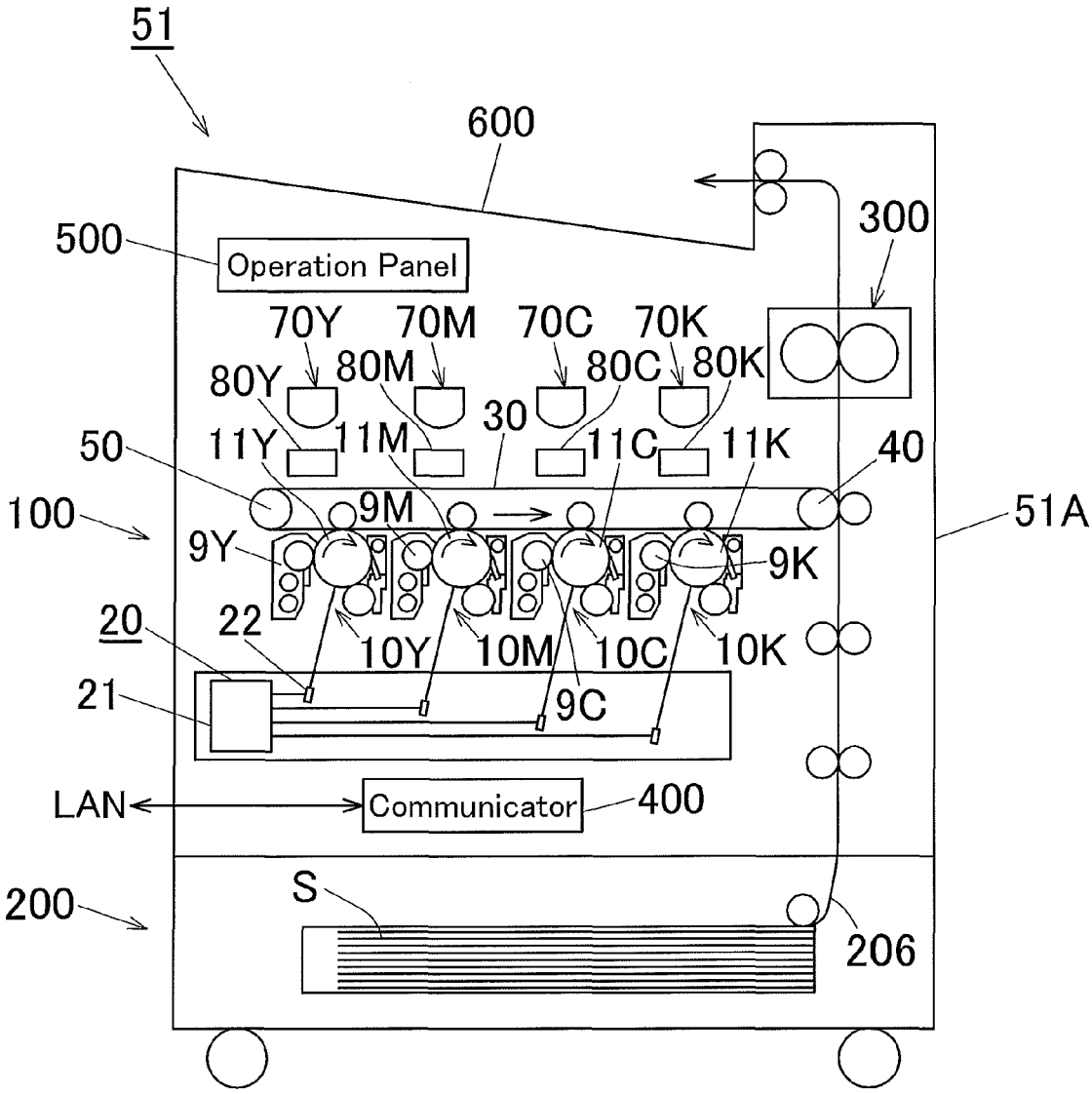
FIG. 2 is a view schematically illustrating a configuration of an image forming apparatus employed in the replacement toner cartridge management system of FIG. 1.

FIG. 2 is a view schematically illustrating a configuration of the image forming apparatus 51. In this example, a tandem color printer is employed as the image forming apparatus 51.

As illustrated in FIG. 1, the image forming apparatus 51 has a paper feeder 200 in the lower area of the body 51A, a color image former 100 in the middle area of the body 51A, and a paper discharger 600 in the upper area of the body 51A, respectively. A paper conveyance path 206 conveying toward the upper area, paper (a sheet of paper) S provided by the paper feeder 200 is extended all the way from the paper feeder 200 to the paper discharger 600.

The color image former 100 includes: a driving roller 40 and a driven roller 50 provided in the middle area of the vertical direction of the body 51A; a midway transfer belt 30 horizontally going around a group of the driving roller 40 and the driven roller 50 to run toward the direction indicated by arrow; and image forming units 10Y, 10M, 10C, and 10K containing yellow (Y), magenta (M), cyan (C), and black (K) of toner, respectively, provided along the belt's running direction.

Toner images formed by the image forming units 10Y, 10M, 10C, and 10K are layered together and transferred onto the transfer belt 30. In the second transfer process, the merged toner images are further transferred on the paper S passing trough the corner of the transfer belt 30 (on the extreme right of the body) via the paper conveyance path 206; the sheet S is conveyed to a fuser 300 to have the merged toner images fixed thereon.

The image forming units 10Y, 10M, 10C, and 10K forming images by the electrostatic copy method is provided with: a charger; a print head 21 including four laser diodes, a polygon mirror, a scanner lens, and the like; an exposure unit 20 including four reflection mirrors 22 and the like; development devices 9Y, 9M, 9C, and 9K; photoreceptor drums 11Y, 11M, 11C, and 11K; a transfer portion; and the like, which are all located in the vicinity of the image forming units themselves.

Above the image forming units 10Y, 10M, 10C, and 10K, toner cartridges 70Y, 70M, 70C, and 70K and sub-hoppers 80Y, 80M, 80C, and 80K are provided as supplier machineries that feed toner in the development devices 9Y, 9M, 9C, and 9K of the image forming units 10Y, 10M, 10C, and 10K, respectively.

The toner cartridges 70Y, 70M, 70C, and 70K are removablly loaded on the body 51A so as to be replaced with new ones when need. The toner cartridges 70Y, 70M, 70C, and 70K have a fuse attached thereto but not illustrated in this drawing; the body 51A detects an unused state of the toner cartridges when their fuses are conductive, and releases the unused state when the fuses are cut out. In other words, cutting the fuses, replacement of the toner cartridges is recognized.

In FIG. 1, a portion with the number 400 is a communicator communicating with external machines, and a portion with the number 500 is an operation panel provided with a set of keys and a display.

Figure 3:
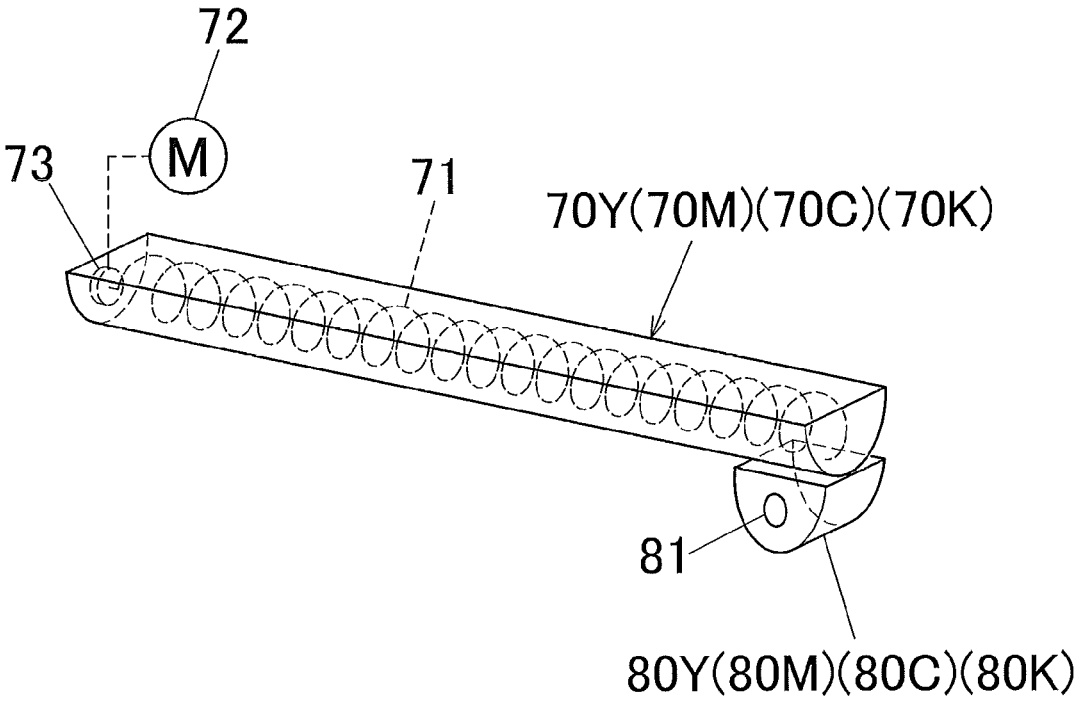
FIG. 3 is a view to explain the image forming apparatus's machinery to feed toner in a sub-hopper from a toner cartridge.

FIG. 3 is a view to explain a machinery to feed toner in the sub-hoppers 80Y, 80M, 80C, and 80K from the toner cartridges 70Y, 70M, 70C, and 70K, respectively.

As illustrated in FIG. 3, when the toner cartridges 70Y, 70M, 70C, and 70K are loaded on the body 51A, the sub-hoppers 80Y, 80M, 80C, and 80K open shutters on their top to receive toner from the toner cartridges 70Y, 70M, 70C, and 70K.

The toner cartridge 70Y, 70M, 70C, and 70K have a spiral spring 71 inside, and feed toner in the sub-hoppers 80Y, 80M, 80C, and 80K, respectively, by having their spiral springs 71 rotated by stepper motors (also referred to as cartridge motors) 72.

There provided two stepper motors 72 for the four spiral springs 71; one of the two works for the toner cartridges 70Y and 70M, and the other one works for the toner cartridges 70C and 70K. An even number of gears 73 are arranged between an inlet valve of the toner cartridges 70Y and 70C and an inlet valve for the toner cartridges 70K and 70M; when the stepper motors 72 perform normal rotation, the spiral springs 71 of the toner cartridges 70Y and 70C are properly rotated while the spiral springs 71 of the toner cartridges 70K and 70M are rotated idle, and when the stepper motors 72 perform reverse rotation, the spiral springs 71 of the toner cartridges 70Y and 70C are rotated idle while the spiral springs 71 of the toner cartridges 70K and 70M are properly rotated. Switching the stepper motors 72 between normal rotation and reverse rotation determines whether or not to allow the toner cartridges 70Y, 70M, 70C, and 70K to feed toner.

Figure 4:
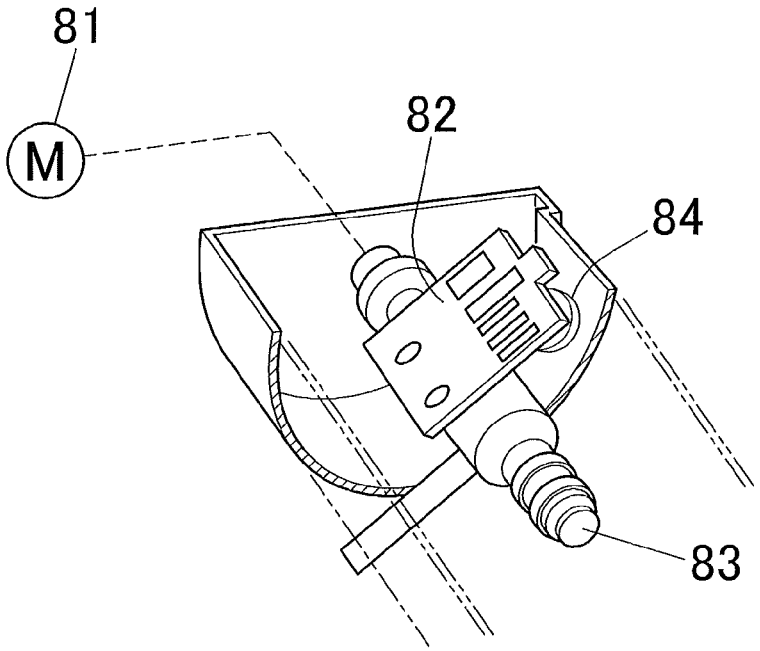
FIG. 4 is a view to explain the image forming apparatus's machinery to feed toner in a development device from the sub-hopper.

FIG. 4 is a view to explain a machinery to feed toner in the development devices 9Y, 9M, 9C, and 9K from the sub-hoppers 80Y, 80M, 80C, and 80K.

As illustrated in FIG. 4, there provided one stepper motor (also referred to as sub-hopper motor) 81 for each of the sub-hoppers, the sub-hoppers 80Y, 80M, 80C, and 81K.

The sub-hoppers 80Y, 80M, 80C, and 80K feed toner in the development devices 9Y, 9M, 9C, and 9K, respectively, by having paddles 82 and spiral rollers 83 inside of themselves rotated by the sub-hopper motors 81. The remaining toner levels of the sub-hoppers 80Y, 80M, 80C, and 80K are detected by a toner empty sensor (piezoelectric sensor) 84.

Figure 5:
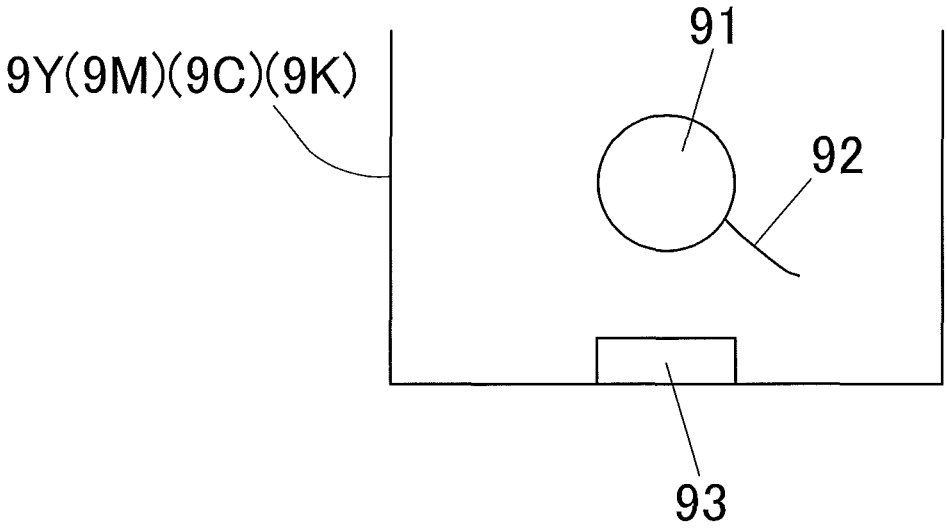
FIG. 5 is a view schematically illustrating a configuration of a machinery to measure toner concentration.

FIG. 5 is a view schematically illustrating a configuration of a machinery to measure toner concentration.

As illustrated in FIG. 5, the development devices 9Y, 9M, 9C, and 9K is filled with developing agent (toner and carrier); the developing agent in the development devices 9Y, 9M, 9C, and 9K is stirred by a Mylar plastic fin 92 attached to a motor-driven screw agitator 91. While the developing agent in the periphery of a toner concentration sensor 93 provided on the bottom of the development devices 9Y, 9M, 9C, and 9K is stirred by the Mylar plastic fin 92, new developing agent is let in the periphery of the toner concentration sensor 93. In other words, the developing agent in the periphery of the toner concentration sensor 93 is replaced with new one every other turn (ripple) of the screw agitator 91.

The toner concentration sensor 93 is a TCR sensor (magnetic sensor), for example. The toner concentration sensor 93 measures the toner concentration of the developing agent by reading out the magnetic permeability of iron included in the carrier of a unit volume of the developing agent in the periphery of the toner concentration sensor 93. That is, the higher a converted value (10-bit resolution) of an analog signal read out by the toner concentration sensor 93 is, the lower the toner concentration is.

Figure 6:
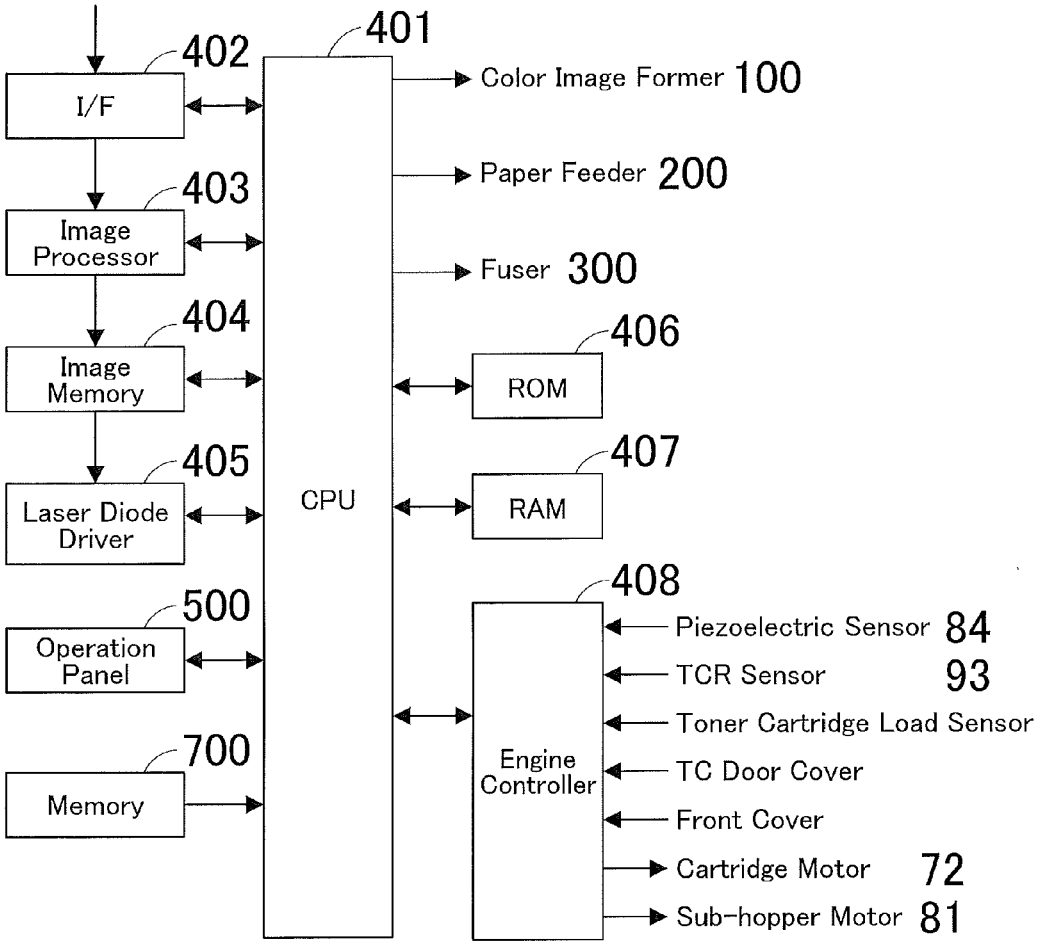
FIG. 6 is a block diagram illustrating a configuration of a controller of the image forming apparatus of FIG. 2.

FIG. 6 is a block diagram illustrating a configuration of a controller of the image forming apparatus 51.

As illustrated in FIG. 6, the controller includes a CPU 401, a communication interface (I/F) 402, an image processor 403, an image memory 404, a laser diode driver 405, an operation panel 500, a recording medium 700, a ROM 406, a RAM 407, and an engine controller 408, as primary members.

The CPU 401 integrally controls all operations of the image forming apparatus 51. Also, the CPU 401 reads out a necessary program from the ROM 406; converts image data by the image processor 403; and writes and reads image data in and out from the image memory 404. Furthermore, the CPU 401 contributes to smooth printing operation by nicely arranging the times of a series of sequential operations of the color image former 100, the paper feeder 200, and the like. Furthermore, the CPU 401 detects (determines) a toner near empty state and an empty state of the toner cartridge 70Y, 70M, 70C, and 70K based on various information inputted from the engine controller 408; arranges the time of detecting (determining) a toner near empty state based on an indicated amount of fed toner and print log data; and displays a predetermined message about the time for replacing the toner cartridges 70Y, 70M, 70C, and 70K, on the operation panel 500. Furthermore, the CPU 401 manages life information of various consumable units such as toner cartridges, a transfer belt unit, a fuser unit, and imaging units such as development units including photoreceptor drums; and transmits the life information to the management server 50 in response to an inquiry from the management server 50.

The communication I/F 402 serves to connect the image forming apparatus 51 to a LAN such as a LAN card or a LAN board, and externally receives data to be printed out according to a print job and transfers it to the image processor 403.

Also, the communication I/F 402 transmits toner empty information, alert information, trouble information, and information of various printing events to the management server 50 managing the image forming apparatus 51 (see FIG. 13) via Internet, and receives data and an instruction from the administration server 50.

Receiving data to be printed out according to a print job from the communication I/F 402, the image processor 403 converts the data into Y, M, C, and K image data objects for color reproduction and outputs the image data objects to the image memory 404 to have them stored thereon.

Reading out Y, M, C, and K image data objects from the image memory 404, the laser diode driver 405 drives the laser diodes of the exposure unit 20.

The operation panel 500 allows users to perform entry operations and displays various messages for them.

The recording medium 700 stores print log data, toner cartridge replacement log data, and the like, as well as various other data and applications.

The ROM 406 stores programs to control image forming operation and other data such as a table serving for toner supply control, toner empty detection control, and other controls.

The RAM 407 serves as a work area for the CPU 402.

Receiving signals and state information from the toner empty sensor 84, the TCR sensor 93, a toner cartridge loading sensor (not illustrated in the drawing), a TC door sensor (not illustrated in the drawing), a front cover (not illustrated in the drawing), the cartridge motors 72, the sub-hopper motors (not illustrated in the drawing), and the like, the engine controller 408 controls printing operation.

Figure 7:
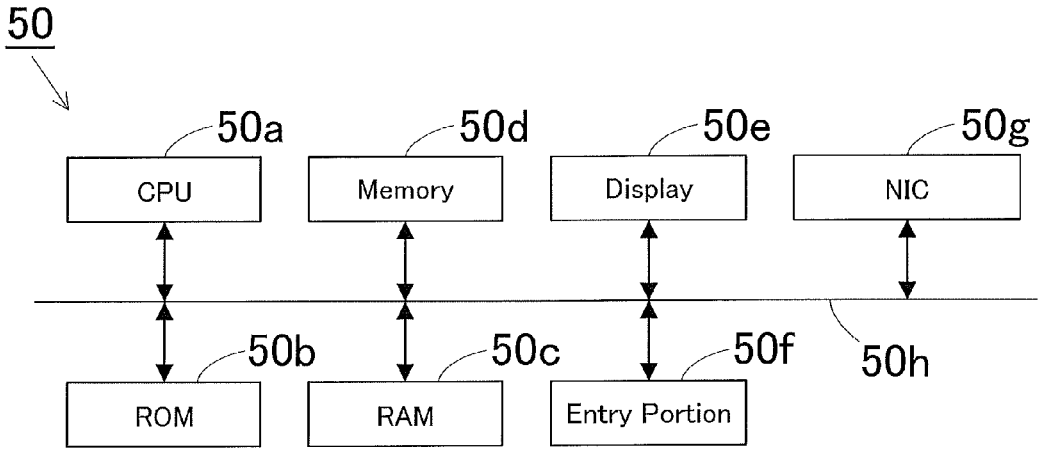
FIG. 7 is a block diagram illustrating a configuration of a replacement toner cartridge management apparatus.

FIG. 7 is a block diagram illustrating a configuration of the management server 50 employed in the replacement toner cartridge management system of FIG. 1.

The management server 50 is provided with a CPU 50*a*, a ROM 50*b*, a RAM 50*c*, a display 50*e*, an entry portion 50*f*, a network interface card (NIC) 50*g*, and the like, which are connected to each other via a system bus 50*h*.

The CPU 50*a* integrally controls the entire management server 50 by executing programs stored on the ROM 50*b*. Specifically, in this mode of embodied implementation, the CPU 50*a* manages information of remaining toner that is a remaining resource contained in the toner cartridges 70Y, 70M, 70C, and 70K loaded on the image forming apparatuses 51; information indicating that the toner cartridges 70Y, 70M, 70C, and 70K are replaced; and other information, and updates the information when the need arises. Also, receiving information indicating that any of the toner cartridges 70Y, 70M, 70C, and 70K is replaced or information incidating that any of the toner cartridges 70Y, 70M, 70C, and 70K nearly runs of toner and will need to be replaced in a short time, the CPU 50*a* determines a right type of replacement toner cartridge and outputs a delivery instruction.

The ROM 50*b* is a recording medium that stores programs and data for the CPU 50*a* to execute processing.

The ROM 50*c* is a recording medium that provides a work area for the CPU 50*a* to execute processing according to an operation program.

The recording medium 50*d* is, for example, a hard disk drive, and stores various data, applications, and the like. Specifically, in this mode of embodied implementation, the recording medium 50*d* stores remaining toner information of the toner cartridges 70Y, 70M, 70C, and 70K loaded on the image forming apparatus 51, which is rewritable thereon. Furthermore, the recording medium 50*d* stores information, for example addresses to which replacement toner cartridges and replacement consumable units will be delivered and used in place of the toner cartridges, the transfer belt unit, the fuser unit, and the development units loaded on the image forming apparatuses 51. The display 50*e* is, for example, a CRT display or a liquid-crystal display, and displays various messages, entry accepting screens, selection screens, and other screens for administrator-level users and other users.

The entry portion 50*f* serves for administrator-level users and other users to perform entry operation, and includes a keyboard, a mouse, and the like.

The network interface card 50*g* serves as a communicator that exchanges data with the image forming apparatuses 51 and the order receiving server 52 via Internet.

Figure 8:
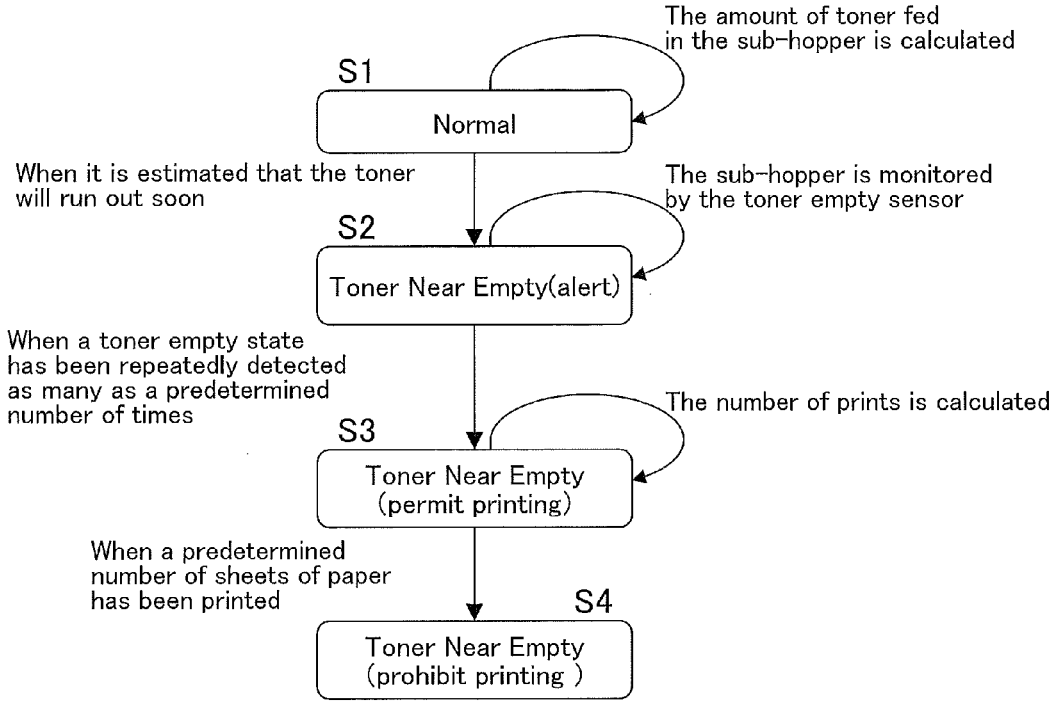
FIG. 8 is a flowchart representing a processing routine to detect a toner empty state.

FIG. 8 is a flowchart representing a processing routine to detect a toner empty state, executed by the image forming apparatuses 51.

In FIG. 8, the remaining toner levels of the toner cartridges 70Y, 70M, 70C, and 70K slowly go down with feeding of toner; the toner cartridges 70Y, 70M, 70C, and 70K eventually run out of toner (become in toner empty state).

There are the four states depending on remaining toner level: "normal" (Step S1), "toner near empty (alert)" (Step S2), "toner empty (permit printing)" (Step S3), and "toner empty (prohibit printing)" (Step S4).

Unlike "toner near empty (alert)" (Step S2), "toner empty (permit printing)" (Step S3), and "toner empty (prohibit printing)" (Step S3), "normal" (Step S1) means that the toner cartridges 70Y, 70M, 70C, and 70K and the sub-hoppers 80Y, 80M, 80C, and 80K are sufficiently filled with toner. In these four states including the state of "normal" (Step S1), the CPU 401 accumulates the rotation quantum numbers of the cartridge motors 72, and estimates the amount of toner fed in the sub-hoppers 80Y, 80M, 80C, and 80K based on the rotation quantum numbers.

Figure 9:
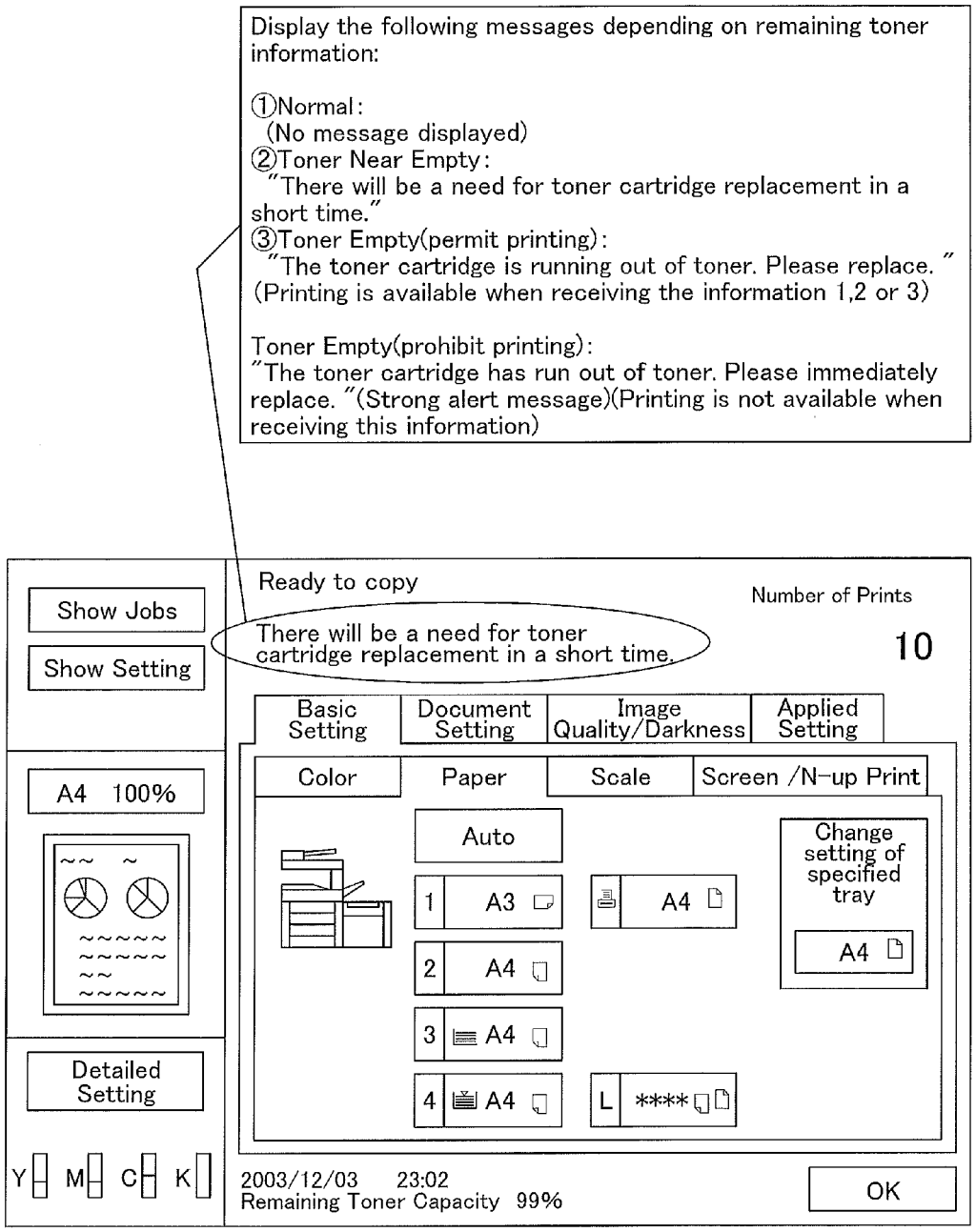
FIG. 9 is a view to explain an example of an alert message displayed on an operation panel of the image forming apparatus.

The CPU 401 determines the state as "toner near empty (alert)" (Step S2) if estimating that the toner cartridges 70Y, 70M, 70C, and 70K nearly run out of toner based on the estimated amount of toner fed in the sub-hoppers 80Y, 80M, 80C, and 80K. In the state of "toner near empty (alert)", as illustrated in FIG. 9, an alert message stating that toner will run out in a short time is displayed on the operation panel 500 so that users will be encouraged to prepare a replacement toner cartridge. After that, thousands of prints still can be made using the toner cartridges 70Y, 70M, 70C and 70K before "toner empty (prohibit printing)" is detected, users therefore have enough time to prepare a replacement toner cartridge even when need to place an order because of no replacement toner cartridges in stock.

The CPU 401 determines the state as "toner empty (permit printing)" (Step S3) when the toner empty sensor 84 has repeatedly detected a toner empty state of the sub-hoppers 80Y, 80M, 80C, and 80K as many as a predetermined number of times. In this state, the toner cartridges 70Y, 70M, 70C, and 70K have no toner left inside while the sub-hoppers 80Y, 80M, 80C, and 80K still contain toner for as many as 100 prints approximately, and printing is therefore permitted.

The CPU 401 determines the state as "toner empty (prohibit printing)" (Step S4) when the sub-hoppers 80Y, 80M, 80C, and 80K run out of toner by further consuming it for a predetermined number of prints after "toner empty (permit printing)" is detected. In this state, printing is prohibited.

In the state of "toner near empty (alert)" (Step S2) and "toner empty (permit printing)" (Step S3), as illustrated in FIG. 9, an alert message is displayed on the operation panel 500 to let the user know that the toner will run out soon. In the state of "toner empty (prohibit printing)" (Step S4), a strong alert message is displayed on the operation panel 500 to let the user know that the toner has run out, and printing is prohibited.

These states depending on remaining toner level: normal, toner near empty, toner empty (permit printing), and toner empty (prohibit printing) (described in Steps S1 to S4, respectively) are incorporated in a table illustrated in FIG. 10.

As is obviously understood from the table of FIG. 10, when the state turns to "toner empty (permit printing)" (Step S3), it is acceptable to replace the toner cartridges 70Y, 70M, 70C, and 70K since these contain little toner (almost run out of toner); when the state turns to "toner near empty" (Step S2), it is not preferred to replace the toner cartridges 70Y, 70M, 70C, and 70K since these still contain some toner.

Figure 11:
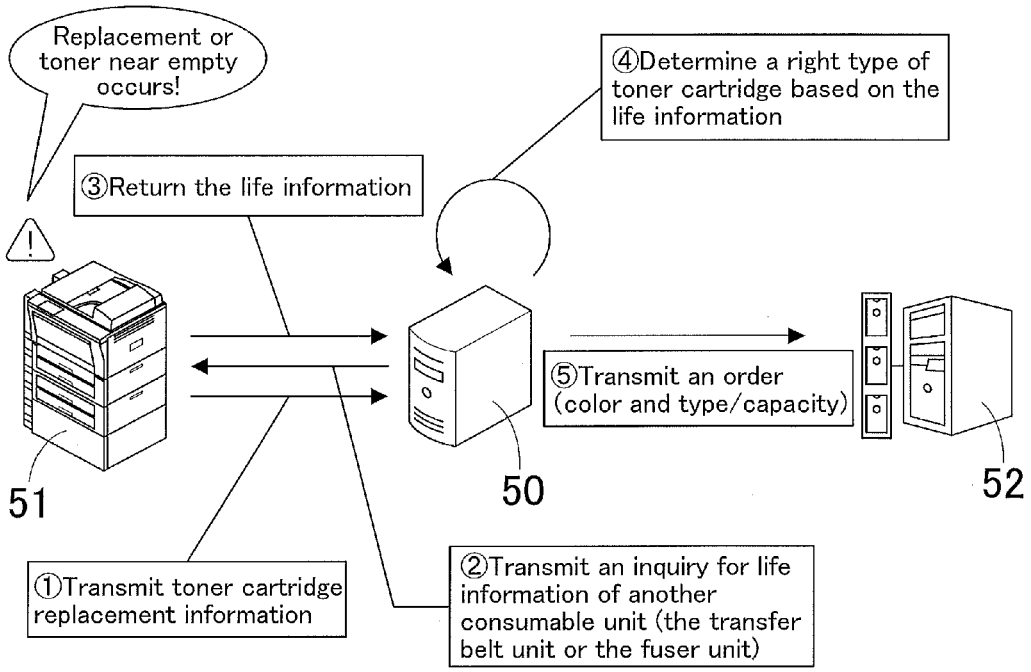
FIG. 11 is a view to explain the overview of a procedure executed by the replacement toner cartridge management system to determine a right type of replacement toner cartridge and output a delivery instruction.

FIG. 11 is a view to explain the overview of a procedure to determine a right type of replacement toner cartridge in place of the toner cartridges 70Y, 70M, 70C, and 70K and output a delivery instruction, in the replacement toner cartridge management system according to this mode of embodied implementation.

In this example, when receiving from any of the image forming apparatuses 51, information about toner cartridge replacement, in other words, toner cartridge replacement information indicating that any of the toner cartridges 70Y, 70M, 70C, and 70K has been replaced or that there is a need to replace any of the toner cartridges 70Y, 70M, 70C, and 70K (for example, that toner near empty occurs to any of them), the management server determines a right type of replacement toner cartridge based on life information of a consumable unit other than the toner cartridges 70Y, 70M, 70C, and 70K, a replacement consumable unit for which will be delivered to the same delivery address as the toner cartridge causing the toner cartridge replacement information.

Initially, one of the toner cartridges loaded on one of the image forming apparatuses 51 is replaced or becomes nearly empty. Then the image forming apparatus 51 transmits information indicating the occurrence of toner cartridge replacement to the management server 50 connected therewith via a communication circuit (circled number 1).

As described above, replacement of the toner cartridges 70Y, 70M, 70C, and 70K is recognized when their attached fuses are cut out. When having its fuse conductive, the image forming apparatus 51 detects the cartridge detection signal as "new toner cartridge"; when having the fuse cut out, it detects the cartridge detection signal as "old toner cartridge". The image forming apparatus 51 further detects a toner near empty state of a toner cartridge.

Receiving the toner cartridge replacement information, the management server 50 returns to the image forming apparatus 51 an inquiry for life information of a consumable unit other than the toner cartridges (circled number 2), and accordingly, the image forming apparatus 51 returns the life information (circled number 3).

Based on the life information received therefrom, the management server 50 determines a right capacity of replacement toner cartridge (circled number 4) and transmits an order for that capacity and the same color as the toner cartridge causing the toner cartridge replacement information, of replacement toner cartridge, to the order receiving server 52 (circled number 5).

Hereinafter, a procedure to determine a right capacity of replacement toner cartridge will be described with reference to FIG. 12. In this example, a consumable unit other than the toner cartridges is a transfer belt unit (referred to simply as transfer belt) including the transfer belt 30, and the procedure will be described under the assumption that: a first predetermined value is 600K, the number of pages printed, on the transfer belt's counter counting the number of pages printed; a second predetermined value is 605K on the transfer belt's counter; the maximum age value of the transfer belt is 610K that is the end-of-life threshold value on the transfer belt's counter; the amount of toner filled in a small-capacity replacement toner cartridge is enough for 10K printed pages on the transfer belt's counter; and the amount of toner filled in a large-capacity replacement toner cartridge is enough for 20K printed pages on the transfer belt's counter.

[CASE-A]

In Case A, when receiving toner cartridge replacement information from any of the image forming apparatuses 51, i.e. when there is a need to deliver a replacement toner cartridge (referred to simply as toner in FIG. 12): the management server outputs an instruction to deliver a small-capacity toner cartridge if life information of the transfer belt obtained from the image forming apparatus 51 exceeds the first predetermined value.

Figure 12A:
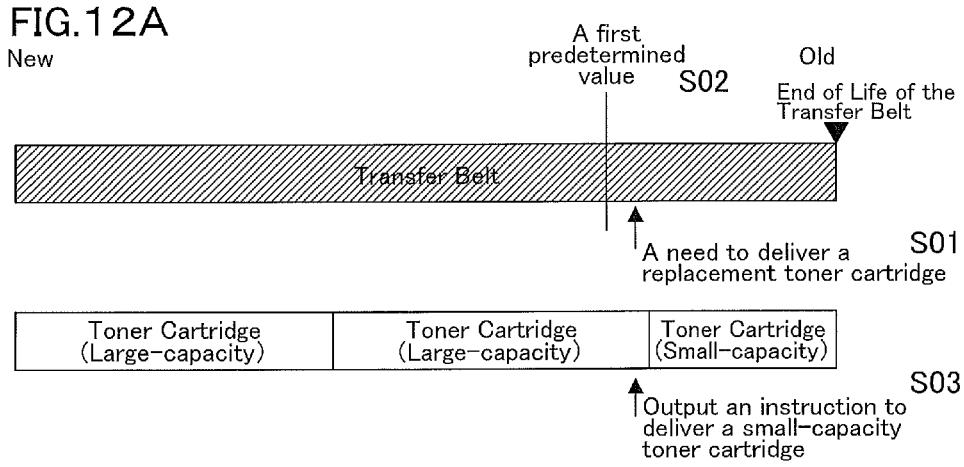
FIG. 12 is a view to explain a procedure to determine a right capacity of replacement toner cartridge.

To further describe this case with reference to FIG. 12(A), when there is a need to deliver a replacement toner cartridge (Step S01): if the life information of the transfer belt exceeds the first predetermined value (Step S02), this means that the transfer belt will reach the end of life in a short time, and it is determined that an instruction to deliver a small-capacity replacement toner cartridge should be outputted so that the transfer belt will reach the end of life and the toner cartridge will run out of toner (the time for replacing the toner cartridge) nicely around the same time (Step S03). In this case, the next time there is a need to deliver a replacement toner cartridge, a service person can visit the user's place as routine with a replacement toner cartridge as well as a replacement transfer belt, which is preferable to delivering them via courier.

[CASE-B]

In Case B, when there is a need to deliver a replacement toner cartridge: the management server outputs an instruction to deliver a large-capacity toner cartridge if life information of the transfer belt obtained from the image forming apparatus 51 does not exceed the first predetermined value.

Figure 12B:
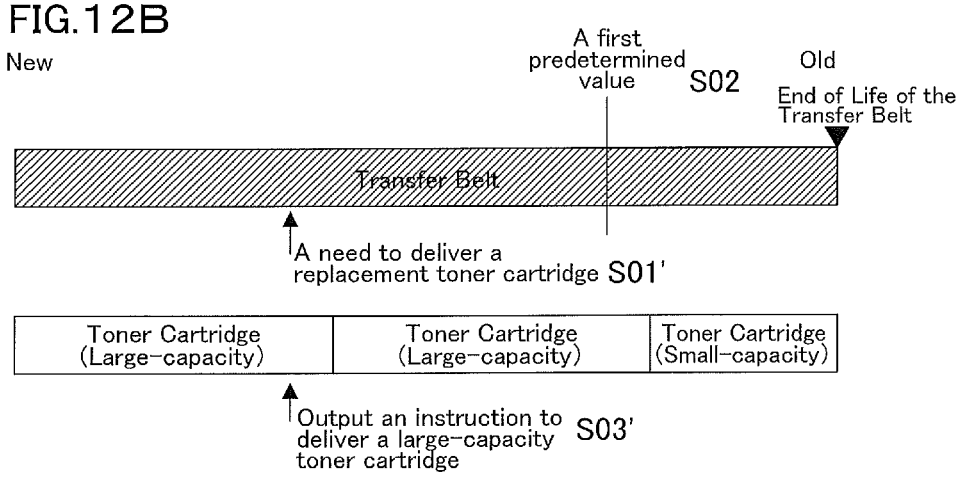

To further describe this case with reference to FIG. 12(B), when there is a need to deliver a replacement toner cartridge (Step S01'): if the life information of the transfer belt does not exceed the first predetermined value (Step S02), this means that the transfer belt will not reach the end of life anytime soon, and it is determined that an instruction to deliver a large-capacity replacement toner cartridge should be outputted (Step S03').

[CASE-C]

In Case C, when there is a need to deliver a replacement toner cartridge: the management server does not output an instruction to deliver a replacement toner cartridge if life information of the transfer belt obtained from the image forming apparatus 51 exceeds the second predetermined value which is larger than the first predetermined value.

Figure 12C:
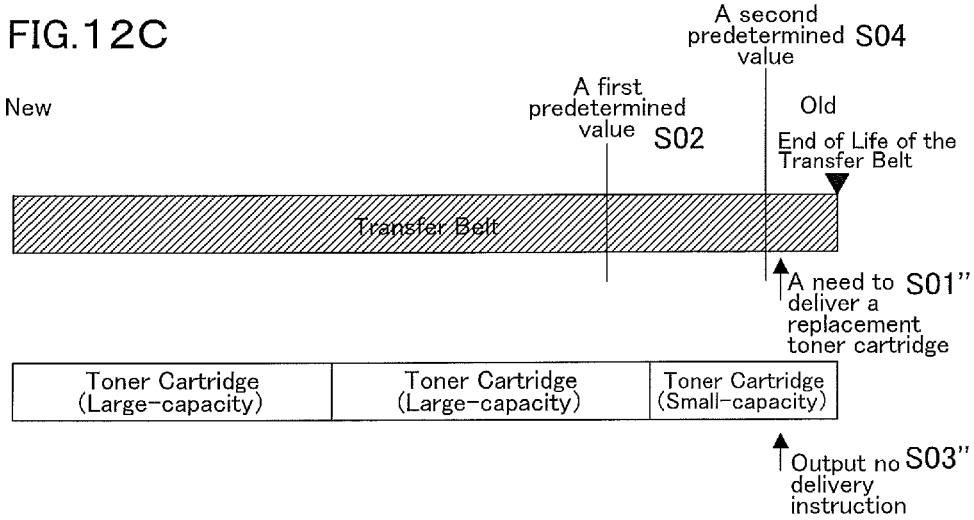

To further describe this case with reference to FIG. 12(C), when there is a need to deliver a replacement toner cartridge (Step S01"): if the life information of the transfer belt exceeds the second predetermined value which is larger than the first predetermined value (Step S04), this means that the transfer belt will reach the end of life in a short time and a service person can visit the user's place as routine with a replacement toner cartridge as well as a replacement transfer belt, and it is determined that no delivery instruction should be outputted (Step S03"). Or alternatively, a replacement toner cartridge may be delivered to a service center if the service center does not have any ones in stock for a service person to go out with.

As described above, in terms of delivery costs, it is advantageous to determine a right capacity of replacement toner cartridge based on life information of a consumable unit other than the toner cartridges so that the user will receive a replacement toner cartridge and a replacement consumable unit delivered at the same time.

Figure 13:
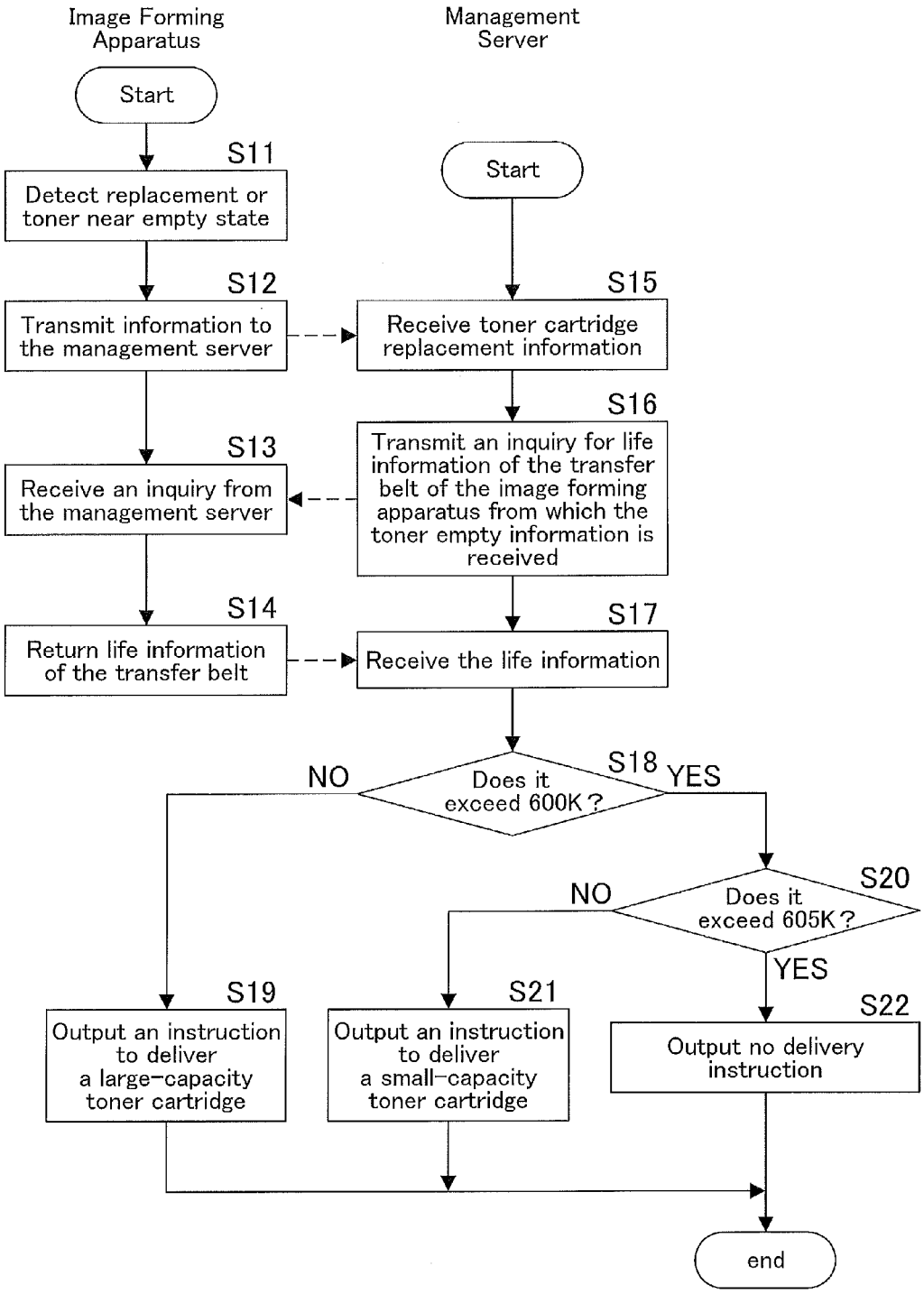
FIG. 13 is a flowchart representing a processing routine executed by the management server to determine a right type of replacement toner cartridge and output an order for it, starting when detecting replacement or a toner near empty state of any of the toner cartridges loaded on any of the image forming apparatuses.

FIG. 13 is a flowchart representing a processing routine executed by the management server 50 to determine a right type of replacement toner cartridge and output an order for it, starting when detecting replacement or a toner near empty state of any of the toner cartridges loaded on the image forming apparatus. The processing routine is executed by the CPU 50*a* of the management server 50 according to an operation program stored on a recording medium such as the ROM 50*b*.

In Step S11, any of the image forming apparatuses 51 detects replacement or a toner near empty state of any of the toner cartridges, which means that there is no replacement toner cartridge in stock or the toner cartridge nearly runs out of toner, respectively, and then in Step S12, the image forming apparatus 51 transmits toner cartridge replacement information to the management server 50.

Receiving the toner cartridge replacement information in Step S15, the management server 50 returns to the image forming apparatus 51 an inquiry for life information of a consumable unit, the transfer belt for example, in Step S16.

Receiving the inquiry for the life information in Step S13, the image forming apparatus 51 returns the life information to the management server 50 in Step S14.

Receiving the life information of the transfer belt in Step S17, the management server 50 judges whether or not the life information exceeds the first predetermined value, for example 600K, the number of pages printed, in Step S18. If the life information does not exceed 600K (NO in Step S18), the routine proceeds to Step S19, in which an order for a large-capacity replacement toner cartridge containing a large amount of toner is outputted to the order receiving server 52.

If the life information exceeds 600K (YES in Step S18), the routine proceeds to Step S20, in which it is judged whether or not the life information exceeds the second predetermined value, for example, 605K. If the life information does not exceed 605K (NO in Step S20), the routine proceeds to Step S21, in which an order for a small-capacity toner cartridge containing a small amount of toner is outputted to the order receiving server 52. If the life information exceeds 605K (YES in Step S20), no order for a replacement toner cartridge is outputted in Step S22.

Figure 14:
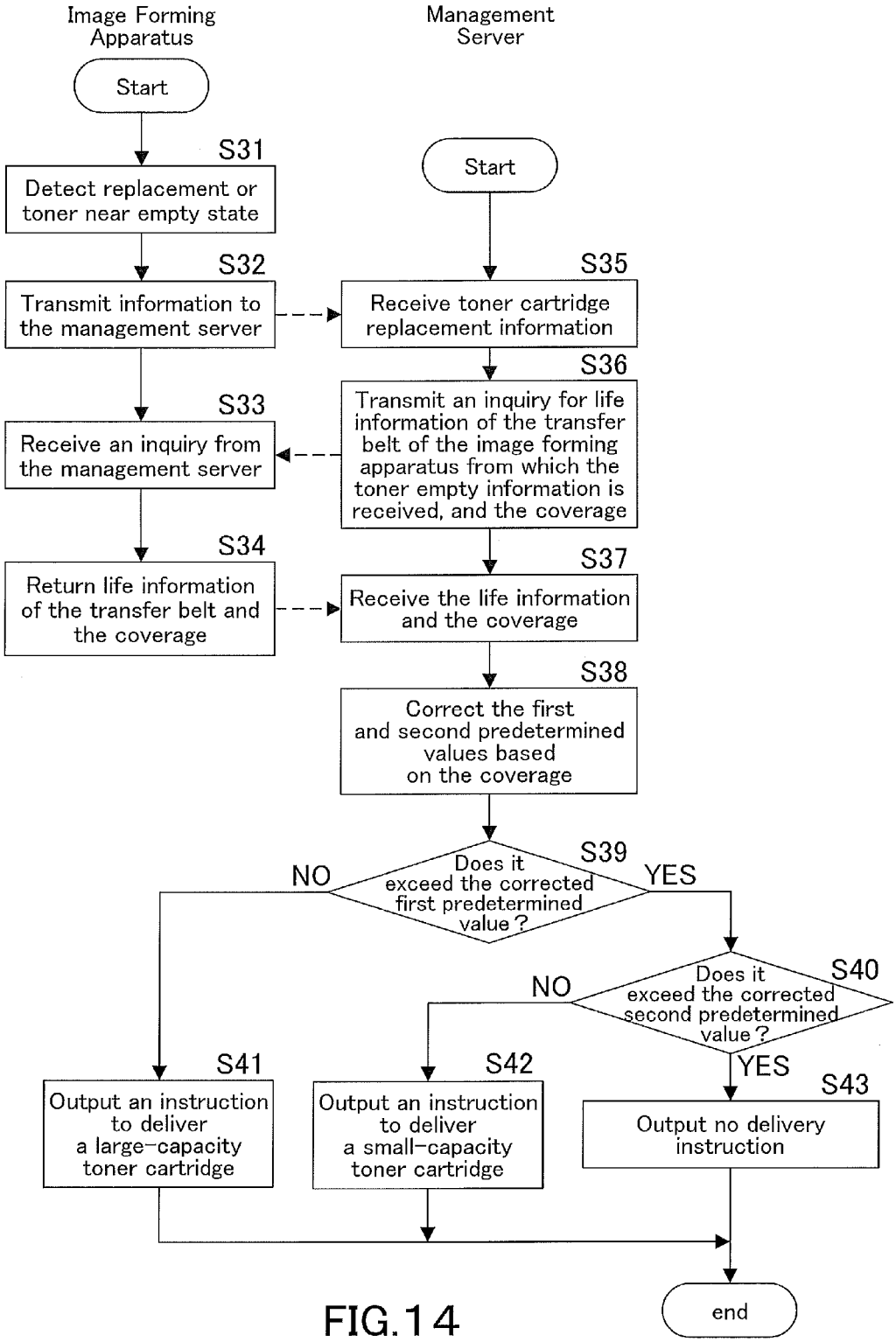
FIG. 14 illustrates another mode of implementing the present invention: it is another flowchart representing a processing routine executed by the management server to determine a right type of replacement toner cartridge and output an order for it, starting when detecting replacement or a toner near empty state of any of the toner cartridges loaded on any of the image forming apparatuses.

FIG. 14 illustrates another mode of implementing the present invention: it is just like FIG. 13, a flowchart representing a processing routine executed by the management server 50 to determine a right type of replacement toner cartridge and output an order for it, starting when detecting replacement or a toner near empty state of any of the toner cartridges loaded on any of the image forming apparatuses 51. In the mode of embodied implementation illustrated in FIG. 13, the first and second predetermined values on the transfer belt's counter counting the number of pages printed are fixed ones. The transfer belt's counter usually counts the number of printed pages one by one not based on the user's use conditions, but the deterioration levels of the toner cartridges actually depend on the amount of toner used per one printed page (coverage) that is the user's use condition, and does not constantly rise, like that of the transfer belt, with increase of the number of the counter. Therefore, if the first and second predetermined values are fixed ones, there may be a problem with the accuracy of arranging things so that the user will receive a replacement toner cartridge and a replacement consumable unit delivered at the same time.

In the second mode of embodied implementation illustrated in FIG. 14, the first and second predetermined values are corrected based on coverage data. The coverage here refers to an average of the ratio of Black (B)/White (W).

The processing routine of FIG. 14 is executed by the CPU 50*a* of the management server 50 according to an operation program stored on a recording medium such as the ROM 50*b*.

In Step S31, the image forming apparatus 51 detects replacement or a toner near empty state of any of the toner cartridges, which means that there is no replacement toner cartridge in stock or the toner cartridge nearly runs out of toner, and then in Step S32, the image forming apparatus 51 transmits toner cartridge replacement information to the management server 50.

Receiving the toner cartridge replacement information in Step S35, the management server 50 returns to the image forming apparatus 51 an inquiry for life information of a consumable unit such as the transfer belt and the coverage in Step S36.

Receiving the inquiry for the life information and the coverage in Step S33, the image forming apparatus returns the life information and the coverage to the management server 50 in Step S34.

Receiving the life information and the coverage in Step S37, the management server 50 corrects the first and second predetermined values based on the coverage in Step S38. Specifically, if the coverage is 75% or higher, this means that the toner cartridge will run out of toner in a short time; and the first and second predetermined values therefore are set to 603K and 608K, respectively, a little closer to the maximum age value of the transfer belt, so that the transfer belt will reach the end of life and the toner cartridge will run out of toner nicely around the same time. If the coverage is 24% or lower, this means that the toner cartridge will not run out of toner anytime soon, and the first and second predetermined values therefore are set to 597K and 601K, respectively, a little away from the maximum age value of the transfer belt, so that the transfer belt will reach the end of life and the toner cartridge will run out of toner nicely around the same time. In this way, the accuracy of arranging things so that the user will receive a replacement toner cartridge and a replacement consumable unit delivered at the same time can be improved.

Although, in this mode of embodied implementation, log data about printing operation is used as the coverage to correct the first and second predetermined values, the coverage is not limited to this information. Alternatively, information about remaining toner level may be used as the coverage to correct the first and second predetermined values.

Subsequently, it is judged in Step S39, whether or not the life information of the transfer belt received from the image forming apparatus 51 exceeds the corrected first predetermined value. If the life information does not exceed the corrected first predetermined value (NO in Step S39), the routine proceeds to Step S41, in which an order for a large-capacity replacement toner cartridge containing a large amount of toner is outputted to the order receiving server 52.

If the life information exceeds the corrected first predetermined value (YES in Step S39), the routine proceeds to Step S40, in which it is judged whether or not the life information exceeds the corrected second predetermined value. If the life information does not exceed the corrected second predetermined value (NO in Step S40), the routine proceeds to Step S42, in which an order for a small-capacity toner cartridge containing a small amount of toner is outputted to the order receiving server 52. If the life information exceeds the corrected second predetermined value (YES in Step S40), it is determined that no order for a replacement toner cartridge should be outputted in Step S43.

Figure 16:
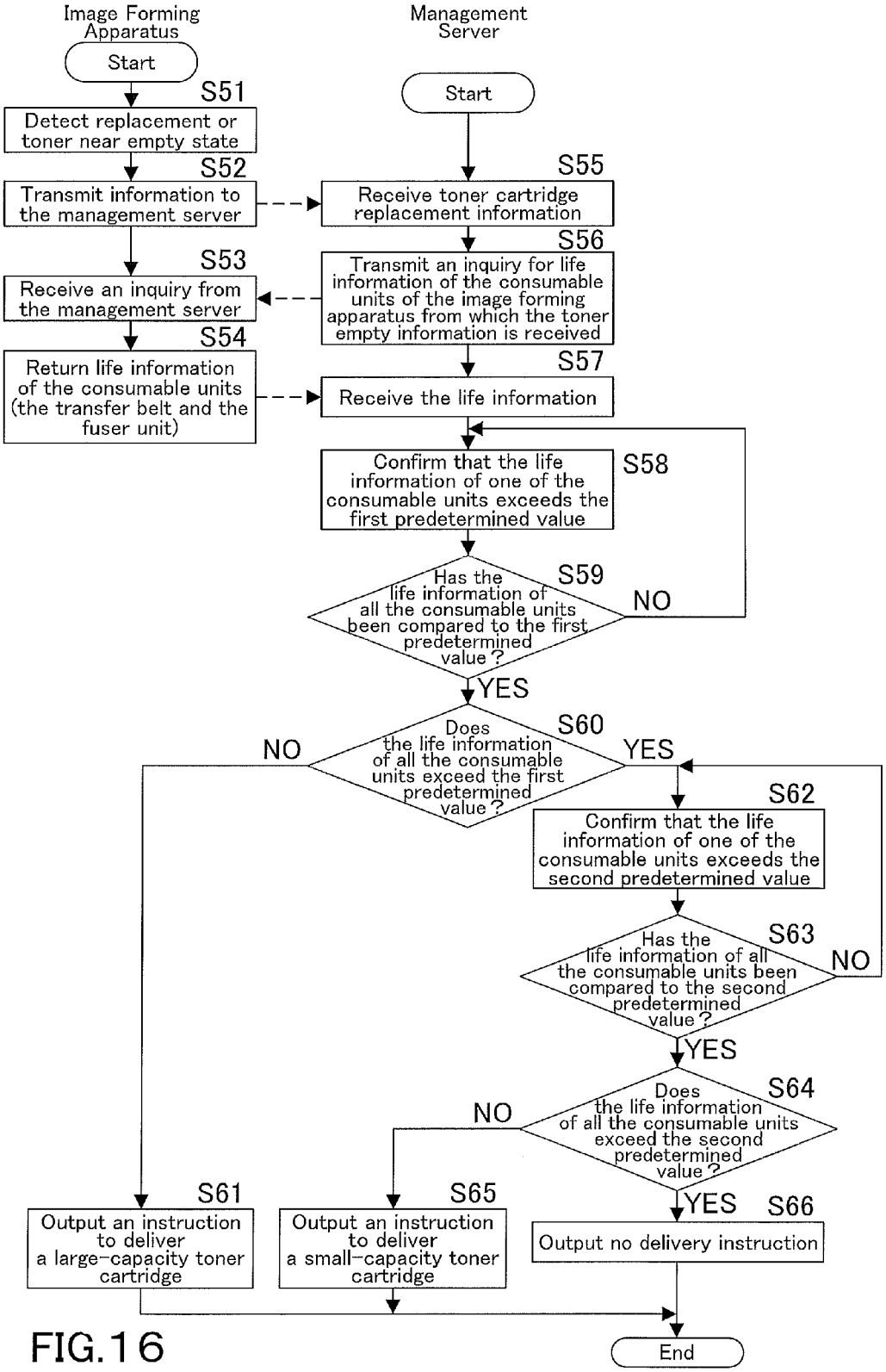
FIG. 16 illustrates yet another mode of implementing the present invention: it is yet another flowchart representing a processing routine executed by the management server to determine a right type of replacement toner cartridge and output an order for it, starting when detecting replacement or a toner near empty state of any of the toner cartridges loaded on any of the image forming apparatuses.

FIG. 16 illustrates yet another mode of implementing the present invention: it is just like FIGS. 13 and 14, a flowchart representing a processing routine executed by the management server 50 to determine a right type of replacement toner cartridge and output an order for it, starting when detecting replacement or a toner near empty state of any of the toner cartridges loaded on any of the image forming apparatuses 51.

In general, the costs of manufacturing small-capacity toner cartridges is higher than that of manufacturing large-capacity toner cartridges, and it is actually preferred to deliver large-capacity toner cartridges rather than small-capacity toner cartridges as much as possible. In the mode of embodied implementation illustrated in FIG. 13, a right type of replacement toner cartridge is determined based on life information of one consumable unit. However, if any other consumable unit will not reach the end of life anymore soon, i.e. if life information of any other consumable unit does not exceed the first predetermined value, it should be more cost-effective to deliver a large-capacity replacement toner cartridge for this time, because there will be another chance of determining a right type of replacement toner cartridge when the consumable unit nearly reaches the end of life.

In this mode of embodied implementation illustrated in FIG. 16, a large-capacity toner cartridge ensuring lower manufacturing costs is preferably selected based on life information of more than one consumable unit other than the toner cartridges.

In this mode of embodied implementation to be described below, life information of the transfer belt and a fuser unit including the fuser 300 is obtained.

The processing routine of FIG. 16 is executed by the CPU 50*a* of the management server 50 according to an operation program stored on a recording medium such as the ROM 50*b*.

In Step S51, any of the image forming apparatuses 51 detects replacement or a toner near empty state of any of the toner cartridges, which means that there is no replacement toner cartridge in stock or the toner cartridge nearly runs out of toner, respectively, and then in Step S52, the image forming apparatus 51 transmits toner cartridge replacement information to the management server 50.

Receiving the toner cartridge replacement information in Step S55, the management server 50 returns to the image forming apparatus 51 an inquiry for life information of the consumable units, the transfer belt unit and the fuser unit in Step S56.

Receiving the inquiry for the life information in Step S53, the image forming apparatus 51 returns the life information to the management server 50 in Step S54.

Receiving the life information in Step S57, the management server 50 confirms that the life information of one of the consumable units, the transfer belt for example, exceeds the first predetermined value in Step S58, and judges whether or not the life information of all the consumable units has been compared to the first predetermined value in Step S59. If the life information of all the consumable units has not been compared to the first predetermined value (NO in Step S59), the routine goes back to Step S58, in which it is judged whether or not the life information of another one of the consumable units exceeds the first predetermined value.

If the life information of all the consumable units has been compared to the first predetermined value (YES in Step S59), then it is judged in Step S60 whether or not the life information of all the consumable units exceeds the first predetermined value. If the life information of at least one of the consumable units does not exceed the first predetermined value (NO in Step S60), the routine proceeds to Step S61, in which an order for a large-capacity replacement toner cartridge containing a large amount of toner is outputted to the order receiving server 52.

If the life information of all the consumable units exceeds the first predetermined value (YES in Step S60), then it is confirmed that the life information of one of the consumable units, the transfer belt for example, exceeds the second predetermined value in Step S62, and it is judged whether or not the life information of all the consumable units has been compared to the second predetermined value in Step S63. If the life information of all the consumable units has not been compared to the second predetermined value (NO in Step S63), the routine goes back to Step S62, in which it is judged whether or not the life information of another one of the consumable units exceeds the second predetermined value.

If the life information of all the consumable units has been compared to the second predetermined value (YES in Step S63), then it is judged in Step S64 whether or not the life information of all the consumable units exceeds the second predetermined value. If the life information of at least one of the consumable units does not exceed the second predetermined value (NO in Step S64), the routine proceeds to Step S65, in which an order for a small-capacity replacement toner cartridge containing a small amount of toner is outputted to the order receiving server 52.

If the life information of all the consumable units exceeds the second predetermined value (YES in Step S64), it is determined that no order for a replacement toner cartridge should be outputted in Step S66.

FIG. 17 is a table illustrating the right types of toner cartridge depending on the life information of the transfer belt unit and the fuser unit. As is understood from the table of FIG. 17: if the life information of either of the consumable units does not exceed the first predetermined value, an order for a large-capacity toner cartridge is outputted; if the life information of both of the consumable units exceeds the first predetermined value while the life information of either of the consumable units does not exceed the second predetermined value, an order for a small-capacity toner cartridge is outputted; and if the life information of both of the consumable units exceeds the second predetermined value, no order is outputted.

As described above, in this mode of embodied implementation, if the life information of at least one of the consumable units does not exceed the first predetermined value, a large-capacity toner cartridge containing a large amount of toner and ensuring lower manufacturing costs is preferably selected and ordered.

The modes of implementing the present invention have been described in the foregoing specification, which does not mean that the present invention shall be construed as limited to the particular forms disclosed. For example, the consumable unit is a transfer belt unit in two of the modes of embodied implementation, and the consumable units are a transfer belt unit and a fuser unit in the other mode of the embodied implementation. Actually, the present invention may be applied to any consumable units loaded on the image forming apparatuses 51, for example development units including the development devices 9Y, 9M, 9C, and 9K and the toner cartridges other than the toner cartridge causing the toner cartridge replacement information, as long as their life information is stored, Furthermore, in the modes of embodied implementation, when there is a need to replace any of the toner cartridges loaded on any of the image forming apparatuses 51, life information of one or more than one consumable unit other than the toner cartridges, loaded on the same image forming apparatus 51 is obtained and used for a judgment. Alternatively, when there is a need to replace any of the toner cartridges loaded on any of the image forming apparatuses 51 located in the same user's office for example, life information of one or more than one consumable unit other than the toner cartridges, loaded on the other image forming apparatuses 51 located in the same user's office may be obtained and used for a judgment, so that a service person could visit the user's office with a replacement toner cartridge and a replacement consumable unit for those different image forming apparatuses 51. In this case, the management server 50 or the like further needs to store the users' office addresses and judge whether or not a replacement toner cartridge and a replacement consumable unit for those different image forming apparatuses 51 should be carried to the same user's office.

Furthermore, in the modes of embodied implementation, the management server 50, not any of the image forming apparatuses 51, serves to: receive toner cartridge replacement information; collect life information of one or more than one consumable unit; compare the life information to the first predetermined value and/or the second predetermined value; determine a right type of replacement toner cartridge; and output a delivery instruction (output an order). Alternatively, taking over all these functions of the management server 50, one of the image forming apparatuses 51 may serve to: receive toner cartridge replacement information; collect life information of one or more than one consumable unit; compare the life information to the first predetermined value and/or the second predetermined value; determine a right type of replacement toner cartridge; and output a delivery instruction (output an order). In this case, the operations described above are performed according to an operation program by the control of the CPU 401 of the image forming apparatus 51.

Furthermore, in the modes of embodied implementation, there is the order receiving server 52 and the management server 50 outputs a delivery instruction to the order receiving server 52. Alternatively, the management server 50 may output a message encouraging the users to place an order: on the display 50*e* of the management server 50 itself; on a display of another machine such as a personal computer; or on a display of the operation panel 500 of one of the image forming apparatuses 51 if it takes over the functions of the management server 50. In this case, an order placement operation is manually performed.

The consumable units to be loaded on the image forming apparatuses may also serve as those to be loaded on inkjet image forming apparatuses.

Each of the following is one aspect of the present invention of the subject application having been described above: a replacement toner cartridge management apparatus which contributes to the saving on delivery costs by arranging things so that a toner cartridge and another consumable unit can be replaced with new ones, respectively, at the same time; a replacement toner cartridge management system; an image forming apparatus; a replacement toner cartridge management method; and recording mediums.

[1] A replacement toner cartridge management apparatus provided with:

a receiver which receives toner cartridge replacement information indicating a toner cartridge loaded on one or more than one image forming apparatus which the replacement toner cartridge management apparatus can access via a communication circuit has been replaced or needs to be replaced with a new one;

a life information obtainer which obtains the life information of a consumable unit other than the toner cartridge causing the toner cartridge replacement information received by the receiver, a replacement consumable unit for which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer; and a transmitter which outputs an instruction to deliver the right type of replacement toner cartridge determined by the determiner.

[2] The replacement toner cartridge management apparatus as recited in the aforementioned item [1], wherein:

the right types of toner cartridge determined by the determiner are different depending on capacity; and if the life information obtained by the life information obtainer exceeds a first predetermined value, the determiner makes a first decision to output an instruction to deliver a small-capacity toner cartridge containing a small amount of toner as a replacement toner cartridge; if it does not exceeds the first predetermined value, the determiner makes a second decision to output an instruction to deliver a large-capacity toner cartridge containing a large amount of toner as a replacement toner cartridge; or if exceeds a second predetermined value which is larger than the first predetermined value, the determiner makes a third decision to output no delivery instruction.

[3] The replacement toner cartridge management apparatus as recited in the aforementioned item [1], wherein the consumable unit is at least one of a group of toner cartridges other than the toner cartridge causing the toner cartridge replacement information, a transfer belt unit, a fuser unit, and development units.

[4] The replacement toner cartridge management apparatus as recited in the aforementioned item [2], further provided with a corrector which corrects the first and second predetermined values based on the toner consumption data of the toner cartridge causing the toner cartridge replacement information.

[5] The replacement toner cartridge management apparatus as recited in the aforementioned item [2], wherein:

the life information obtainer obtains the life information of more than one consumable unit; and if the life information of at least one of the consumable units does not exceed the first predetermined value, the determiner makes the second decision to output an instruction to deliver a large-capacity toner cartridge containing a large amount of toner.

[6] The replacement toner cartridge management apparatus as recited in the aforementioned item [1], wherein the transmitter outputs the delivery instruction to an order receiving server which the replacement toner cartridge management apparatus can access via a communication circuit.

[7] An image forming apparatus provided with:

a receiver which receives toner cartridge replacement information indicating that a toner cartridge loaded on the image forming apparatus or on a different image forming apparatus which the image forming apparatus can access via a communication circuit has been replaced or needs to be replaced with a new one;

a life information obtainer which obtains the life information of a consumable unit other than the toner cartridge causing the toner cartridge replacement information received by the receiver, a replacement consumable unit for which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer; and a transmitter which outputs an instruction to deliver the right type of replacement toner cartridge determined by the determiner.

[8] The image forming apparatus as recited in the aforementioned item [7], wherein:

the right types of toner cartridge determined by the determiner are different depending on capacity; and if the life information obtained by the life information obtainer exceeds a first predetermined value, the determiner makes a first decision to output an instruction to deliver a small-capacity toner cartridge containing a small amount of toner as a replacement toner cartridge; if it does not exceed the first predetermined value, the determiner makes a second decision to output an instruction to deliver a large-capacity toner cartridge containing a large amount of toner as a replacement toner cartridge; or if it exceeds a second predetermined value which is larger than the first predetermined value, the determiner makes a third decision to output no delivery instruction.

[9] The image forming apparatus as recited in the aforementioned item [7], wherein the consumable unit is at least one of a group of toner cartridges other than the toner cartridge causing the toner cartridge replacement information, a transfer belt unit, a fuser unit, and development units.

[10] The image forming apparatus as recited in the aforementioned item [8], further provided with a corrector which corrects the first and second predetermined values based on the toner consumption data of the toner cartridge causing the toner cartridge replacement information.

[11] The image forming apparatus as recited in the aforementioned item [8], wherein:

the life information obtainer obtains the life information of more than one consumable unit; and if the life information of at least one of the consumable units does not exceed the first predetermined value, the determiner makes the second decision to output an instruction to deliver a large-capacity toner cartridge containing a large amount of toner.

[12] The image forming apparatus as recited in the aforementioned item [7], wherein the transmitter outputs the delivery instruction to an order receiving server which the image forming apparatus can access via a communication circuit.

[13] A replacement toner cartridge management system provided with a replacement toner cartridge management apparatus and one or more than one image forming apparatus having one or more than one toner cartridge and one or more than one other consumable unit loaded thereon which can access each other via a communication network, wherein:

the image forming apparatus is provided with a transmitter which transmits toner cartridge replacement information indicating the toner cartridge has been replaced or needs to be replaced with a new one; and the replacement toner cartridge management apparatus is provided with:

a receiver which receives the toner cartridge replacement information;

a life information obtainer which obtains the life information of any of the consumable units other than the toner cartridge causing the toner cartridge replacement information received by the receiver, a replacement consumable unit for which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer; and a transmitter which outputs an instruction to deliver the right type of replacement toner cartridge determined by the determiner.

[14] The replacement toner cartridge management system as recited in the aforementioned item [13], wherein:

the right types of toner cartridge determined by the determiner are different depending on capacity; and if the life information obtained by the life information obtainer exceeds a first predetermined value, the determiner makes a first decision to output an instruction to deliver a small-capacity toner cartridge containing a small amount of toner as a replacement toner cartridge; if it does not exceed the first predetermined value, the determiner makes a second decision to output an instruction to deliver a large-capacity toner cartridge containing a large amount of toner as a replacement toner cartridge; or if it exceeds a second predetermined value which is larger than the first predetermined value, the determiner makes a third decision to output no delivery instruction.

[15] The replacement toner cartridge management system as recited in the aforementioned item [13], wherein the consumable unit is at least one of a group of toner cartridges other than the toner cartridge causing the toner cartridge replacement information, a transfer belt unit, a fuser unit, and development units.

[16] The replacement toner cartridge management system as recited in the aforementioned item [14], further provided with a corrector which corrects the first and second predetermined values based on the toner consumption data of the toner cartridge causing the toner cartridge replacement information.

[17] The replacement toner cartridge management system as recited in the aforementioned item [14], wherein:

the life information obtainer obtains the life information of more than one consumable unit; and if the life information of at least one of the consumable units does not exceed the first predetermined value, the determiner makes the second decision to output an instruction to deliver a large-capacity toner cartridge containing a large amount of toner.

[18] The replacement toner cartridge management system as recited in the aforementioned item [13], wherein the transmitter of the replacement toner cartridge management apparatus outputs the delivery instruction to an order receiving server which the replacement toner cartridge management apparatus can access via a communication circuit.

[19] A replacement toner cartridge management method implemented by a replacement toner cartridge management system provided with a replacement toner cartridge management apparatus and one or more than one image forming apparatus having one or more than one toner cartridge and one or more than one other consumable unit loaded thereon, which can access each other via a communication network, including:

the image forming apparatus's transmitting toner cartridge replacement information indicating the toner cartridge has been replaced or needs to be replaced with a new one; and the replacement toner cartridge management apparatus's:

receiving the toner cartridge replacement information;

obtaining the life information of any of the consumable units other than the toner cartridge causing the received toner cartridge replacement information, a replacement consumable unit for which will be delivered to the same delivery address as a replacement toner cartridge for the toner cartridge causing the toner cartridge replacement information;

determining a right type of replacement toner cartridge for the toner cartridge causing the toner cartridge replacement information, based on the obtained life information; and outputting an instruction to deliver the right type of replacement toner cartridge.

[20] A non-transitory computer-readable recording medium having a replacement toner cartridge management program stored thereon to make a computer of a replacement toner cartridge management apparatus execute:

receiving toner cartridge replacement information indicating a toner cartridge loaded on one or more than one image forming apparatus which the replacement toner cartridge management apparatus can access via a communication circuit has been replaced or needs to be replaced with a new one;

obtaining the life information of a consumable unit other than the toner cartridge causing the received toner cartridge replacement information, a replacement consumable unit for which will be delivered to the same delivery address as a replacement toner cartridge for the toner cartridge causing the toner cartridge replacement information;

determining a right type of replacement toner cartridge for the toner cartridge causing the toner cartridge replacement information, based on the obtained life information; and outputting an instruction to deliver the right type of replacement toner cartridge.

[21] A non-transitory computer-readable recording medium having a replacement toner cartridge management program stored thereon to make a computer of an image forming apparatus execute:

receiving toner cartridge replacement information indicating that a toner cartridge loaded on the image forming apparatus or on a different image forming apparatus which the image forming apparatus can access via a communication circuit has been replaced or needs to be replaced with a new one;

obtaining the life information of a consumable unit other than the toner cartridge causing the received toner cartridge replacement information, a replacement consumable unit for which will be delivered to the same delivery address as a replacement toner cartridge for the toner cartridge causing the toner cartridge replacement information;

determining a right type of replacement toner cartridge for the toner cartridge causing the toner cartridge replacement information, based on the obtained life information; and outputting an instruction to deliver the right type of replacement toner cartridge.

According to the mode as recited in the aforementioned item [1], when toner cartridge replacement information indicating a toner cartridge has been replaced with a new one or will need to be replaced with a new one in a short time is received, the life information of a consumable unit other than the toner cartridge causing the toner cartridge replacement information, a replacement consumable unit for which will be delivered to the same delivery address as a replacement toner cartridge for the toner cartridge causing the tone cartridge replacement information, is obtained. And a right type of replacement toner cartridge for the toner cartridge causing the toner cartridge replacement information is determined based on the life information, and an instruction to deliver the right type of replacement toner cartridge is outputted.

In other words, when the toner cartridge causing the toner cartridge replacement information needs to be replaced with a new one, a right type of replacement toner cartridge is determined based on the life information of another consumable unit, so that the replacement toner cartridge and the consumable unit whose life information is obtained can be replaced with new ones, respectively, at the same time.

As a result, a service person will be able to visit the user's place with both a next replacement toner cartridge for the replacement toner cartridge and a replacement consumable unit, or alternatively the user will be able to receive them delivered at the same time. By allowing a service person to do so or outputting an instruction to deliver them at the same time, the delivery costs can be saved.

According to the mode as recited in the aforementioned item [2], if the life information of one or more than one consumable unit such as a toner cartridge other than the toner cartridge causing the toner cartridge replacement information, a transfer belt unit, a fuser unit, and/or a development unit, which is obtained by the life information obtainer exceeds a first predetermined value, this means that the consumable unit will reach the end of life in a short time. And an instruction to deliver a small-capacity toner cartridge containing a small amount of toner is outputted so that it will be empty also in a short time.

If the life information of the consumable unit does not exceed the first predetermined value, an instruction to deliver a large-capacity toner cartridge containing a large amount of toner is outputted so that it will not be empty in a short time.

If the life information of the consumable unit exceeds a second predetermined value which is larger than the first predetermined value, this means that the consumable unit will reach the end of life in a short time, and a service person can visit the user's place as routine with a replacement toner cartridge as well as a replacement consumable unit, so a delivery instruction is not outputted.

According to the mode as recited in the aforementioned item [3], a right type of replacement toner cartridge is determined based on the life information of at least one of a group of a toner cartridge other than the toner cartridge causing the toner cartridge replacement information, a transfer belt unit, a fuser unit, and a development unit, which is obtained by the life information obtainer.

According to the mode as recited in the aforementioned item [4], the first and second predetermined values are corrected based on the toner consumption data of the toner cartridge causing the toner cartridge replacement information. By arranging things in this way, a toner cartridge and another consumable unit can be replaced with new ones, respectively, at the same time.

According to the mode as recited in the aforementioned item [5], if the life information of at least one of the consumable units does not exceed the first predetermined value, an instruction to deliver a large-capacity toner cartridge containing a large amount of toner is outputted.

According to the mode as recited in the aforementioned item [6], an order for a necessary replacement toner cartridge is automatically transmitted to the order receiving server.

According to the mode as recited in the aforementioned item [7], a service person will be able to visit the user's place with both a next replacement toner cartridge for the replacement toner cartridge and a replacement consumable unit, or alternatively the user will be able to receive them delivered at the same time. By allowing a service person to do so or outputting an instruction to deliver them at the same time, the image forming apparatus contributes to the saving on delivery costs.

According to the mode as recited in the aforementioned item [8], a perfect determination is made for the following cases: if the life information of at least one of a group of a toner cartridge other than the toner cartridge causing the toner cartridge replacement information, a transfer belt unit, a fuser unit, and a development unit, which is obtained by the life information obtainer exceeds the first predetermined value; if the life information of the same does not exceeds the first predetermined value; and if the life information of the same exceeds the second predetermined value which is larger than the first predetermined value.

According to the mode as recited in the aforementioned item [9], a right type of replacement toner cartridge is determined based on the life information of at least one of a group of toner cartridges other than the toner cartridge causing the toner cartridge replacement information, a transfer belt unit, a fuser unit, and development units, which is obtained by the life information obtainer.

According to the mode as recited in the aforementioned item [10], the first and second predetermined values are corrected based on the toner consumption data of the toner cartridge causing the toner cartridge replacement information. By arranging things in this way, a toner cartridge and another consumable unit can be replaced with new ones, respectively, at the same time.

According to the mode as recited in the aforementioned item [11], if the life information of at least one of the consumable units does not exceed the first predetermined value, an instruction to deliver a large-capacity toner cartridge containing a large amount of toner is outputted.

According to the mode as recited in the aforementioned item [12], an order for a necessary replacement toner cartridge is automatically outputted to the order receiving server.

According to the mode as recited in the aforementioned item [13], a service person will be able to visit the user's place with both a next replacement toner cartridge for the replacement toner cartridge and a replacement consumable unit, or alternatively the user will be able to receive them delivered at the same time. By allowing a service person to do so or outputting an instruction to deliver them at the same time, the replacement toner cartridge management system contributes to the saving on delivery costs.

According to the mode as recited in the aforementioned item [14], a perfect determination is made for the following cases: if the life information of at least one of a group of a toner cartridge other than the toner cartridge causing the toner cartridge replacement information, a transfer belt unit, a fuser unit, and a development unit, which is obtained by the life information obtainer exceeds the first predetermined value; if the life information of the same does not exceeds the first predetermined value; and if the life information of the same exceeds the second predetermined value which is larger than the first predetermined value.

According to the mode as recited in the aforementioned item [15], a right type of replacement toner cartridge is determined based on the life information of at least one of a group of toner cartridges other than the toner cartridge causing the toner cartridge replacement information, a transfer belt unit, a fuser unit, and development units, which is obtained by the life information obtainer.

According to the mode as recited in the aforementioned item [16], the first and second predetermined values are corrected based on the toner consumption data of the toner cartridge causing the toner cartridge replacement information. By arranging things in this way, a toner cartridge and another consumable unit can be replaced with new ones, respectively, at the same time.

According to the mode as recited in the aforementioned item [17], if the life information of at least one of the consumable units does not exceed the first predetermined value, an instruction to deliver a large-capacity toner cartridge containing a large amount of toner is outputted.

According to the mode as recited in the aforementioned item [18], an order for a necessary replacement toner cartridge is automatically outputted to the order receiving server.

According to the mode as recited in the aforementioned item [19], a service person will be able to visit the user's place with both a next replacement toner cartridge for the replacement toner cartridge and a replacement consumable unit, or alternatively the user will be able to receive them delivered at the same time. By allowing a service person to do so or outputting an instruction to deliver them at the same time, the delivery costs are saved.

According to the mode as recited in the aforementioned item [20], a service person will be able to visit the user's place with both a next replacement toner cartridge for the replacement toner cartridge and a replacement consumable unit, or alternatively the user will be able to receive them delivered at the same time. By executing a process of allowing a service person to do so or outputting an instruction to deliver them at the same time, a computer of a replacement toner cartridge management apparatus contributes to the saving on delivery costs.

According to the mode as recited in the aforementioned item [21], a service person will be able to visit the user's place with both a next replacement toner cartridge for the replacement toner cartridge and a replacement consumable unit, or alternatively the user will be able to receive them delivered at the same time. By executing a process of allowing a service person to do so or outputting an instruction to deliver them at the same time, a computer of an image forming apparatus contributes to the saving on delivery costs.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. A replacement toner cartridge management apparatus comprising:

a receiver which receives toner cartridge replacement information indicating a toner cartridge loaded on one or more than one image forming apparatus which the replacement toner cartridge management apparatus can access via a communication circuit has been replaced or needs to be replaced with a new one;

a life information obtainer which obtains life information of a consumable unit other than the toner cartridge causing the toner cartridge replacement information received by the receiver, the consumable unit being replaced by a replacement consumable unit which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer; and a transmitter which outputs an instruction to deliver the right type of replacement toner cartridge determined by the determiner;

wherein the consumable unit is either or both of a transfer belt unit and a fuser unit.

2. A replacement toner cartridge management apparatus comprising:

a receiver which receives toner cartridge replacement information indicating a toner cartridge loaded on one or more than one image forming apparatus which the replacement toner cartridge management apparatus can access via a communication circuit has been replaced or needs to be replaced with a new one;

a life information obtainer which obtains life information of a consumable unit other than the toner cartridge causing the toner cartridge replacement information received by the receiver, the consumable unit being replaced by a replacement consumable unit which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer;

a transmitter which outputs an instruction to deliver the right type of replacement toner cartridge determined by the determiner; wherein:

the right types of toner cartridge determined by the determiner are different depending on capacity; and if the life information obtained by the life information obtainer exceeds a first predetermined value, the determiner makes a first decision to output an instruction to deliver a small-capacity toner cartridge containing a small amount of toner as a replacement toner cartridge; if the life information does not exceed the first predetermined value, the determiner makes a second decision to output an instruction to deliver a large-capacity toner cartridge containing a large amount of toner as a replacement toner cartridge; or if the life information exceeds a second predetermined value which is larger than the first predetermined value, the determiner makes a third decision to output no delivery instruction.

3. The replacement toner cartridge management apparatus as recited in claim 2, wherein the consumable unit is at least one of a group of toner cartridges other than the toner cartridge causing the toner cartridge replacement information, a transfer belt unit, a fuser unit, and development units.

4. The replacement toner cartridge management apparatus as recited in claim 2, further comprising a corrector which corrects the first and second predetermined values based on the toner consumption data of the toner cartridge causing the toner cartridge replacement information.

5. The replacement toner cartridge management apparatus as recited in claim 2, wherein:

the life information obtainer obtains the life information of more than one consumable unit; and if the life information of at least one of the consumable units does not exceed the first predetermined value, the determiner makes the second decision to output an instruction to deliver a large-capacity toner cartridge containing a large amount of toner.

6. The replacement toner cartridge management apparatus as recited in claim 1, wherein the transmitter outputs the delivery instruction to an order receiving server which the replacement toner cartridge management apparatus can access via a communication circuit.

7. An image forming apparatus comprising:

a receiver which receives toner cartridge replacement information indicating that a toner cartridge loaded on the image forming apparatus or on a different image forming apparatus which the image forming apparatus can access via a communication circuit has been replaced or needs to be replaced with a new one;

a life information obtainer which obtains life information of a consumable unit other than the toner cartridge causing the toner cartridge replacement information received by the receiver, the consumable unit being replaced by a replacement consumable unit which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer; and a transmitter which outputs an instruction to deliver the right type of replacement toner cartridge determined by the determiner;

wherein the consumable unit is either or both of a transfer belt unit and a fuser unit.

8. An image forming apparatus comprising:

a receiver which receives toner cartridge replacement information indicating that a toner cartridge loaded on the image forming apparatus or on a different image forming apparatus which the image forming apparatus can access via a communication circuit has been replaced or needs to be replaced with a new one;

a life information obtainer which obtains life information of a consumable unit other than the toner cartridge causing the toner cartridge replacement information received by the receiver, the consumable unit being replaced by a replacement consumable unit which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer;

a transmitter which outputs an instruction to deliver the right type of replacement toner cartridge determined by the determiner; wherein:

the right types of toner cartridge determined by the determiner are different depending on capacity; and if the life information obtained by the life information obtainer exceeds a first predetermined value, the determiner makes a first decision to output an instruction to deliver a small-capacity toner cartridge containing a small amount of toner as a replacement toner cartridge; if the life information does not exceed the first predetermined value, the determiner makes a second decision to output an instruction to deliver a large-capacity toner cartridge containing a large amount of toner as a replacement toner cartridge; or if the life information exceeds a second predetermined value which is larger than the first predetermined value, the determiner makes a third decision to output no delivery instruction.

9. The image forming apparatus as recited in claim 8, wherein the consumable unit is at least one of a group of toner cartridges other than the toner cartridge causing the toner cartridge replacement information, a transfer belt unit, a fuser unit, and development units.

10. The image forming apparatus as recited in claim 8, further comprising a corrector which corrects the first and second predetermined values based on the toner consumption data of the toner cartridge causing the toner cartridge replacement information.

11. The image forming apparatus as recited in claim 8, wherein:

the life information obtainer obtains the life information of more than one consumable unit; and if the life information of at least one of the consumable units does not exceed the first predetermined value, the determiner makes the second decision to output an instruction to deliver a large-capacity toner cartridge containing a large amount of toner.

12. The image forming apparatus as recited in claim 7, wherein the transmitter outputs the delivery instruction to an order receiving server which the image forming apparatus can access via a communication circuit.

13. A replacement toner cartridge management system comprising a replacement toner cartridge management apparatus and one or more than one image forming apparatus having one or more than one toner cartridge and one or more than one other consumable unit loaded thereon, which can access each other via a communication network, wherein:

the image forming apparatus comprises a transmitter which transmits toner cartridge replacement information indicating the toner cartridge has been replaced or needs to be replaced with a new one; and the replacement toner cartridge management apparatus comprises:

a receiver which receives the toner cartridge replacement information;

a life information obtainer which obtains life information of any of the consumable units other than the toner cartridge causing the toner cartridge replacement information received by the receiver, the consumable unit being replaced by a replacement consumable unit which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer; and a transmitter which outputs an instruction to deliver the right type of replacement toner cartridge determined by the determiner;

wherein the consumable unit is either or both of a transfer belt unit and a fuser unit.

14. A replacement toner cartridge management system comprising a replacement toner cartridge management apparatus and one or more than one image forming apparatus having one or more than one toner cartridge and one or more than one other consumable unit loaded thereon, which can access each other via a communication network, wherein:

the image forming apparatus comprises a transmitter which transmits toner cartridge replacement information indicating the toner cartridge has been replaced or needs to be replaced with a new one; and the replacement toner cartridge management apparatus comprises:

a receiver which receives the toner cartridge replacement information;

a life information obtainer which obtains life information of any of the consumable units other than the toner cartridge causing the toner cartridge replacement information received by the receiver, the consumable unit being replaced by a replacement consumable unit which will be delivered to the same delivery address as a replacement toner cartridge for the toner cartridge causing the toner cartridge replacement information;

a determiner which determines a right type of replacement toner cartridge for the toner cartridge causing the toner cartridge replacement information, based on the life information obtained by the life information obtainer; and a transmitter which outputs an instruction to deliver the right type of replacement toner cartridge determined by the determiner; wherein:

the right types of toner cartridge determined by the determiner are different depending on capacity; and if the life information obtained by the life information obtainer exceeds a first predetermined value, the determiner makes a first decision to output an instruction to deliver a small-capacity toner cartridge containing a small amount of toner as a replacement toner cartridge; if the life information does not exceed the first predetermined value, the determiner makes a second decision to output an instruction to deliver a large-capacity toner cartridge containing a large amount of toner as a replacement toner cartridge; or if the life information exceeds a second predetermined value which is larger than the first predetermined value, the determiner makes a third decision to output no delivery instruction.

15. The replacement toner cartridge management system as recited in claim 14, wherein the consumable unit is at least one of a group of toner cartridges other than the toner cartridge causing the toner cartridge replacement information, a transfer belt unit, a fuser unit, and development units.

16. The replacement toner cartridge management system as recited in claim 14, further comprising a corrector which corrects the first and second predetermined values based on the toner consumption data of the toner cartridge causing the toner cartridge replacement information.

17. The replacement toner cartridge management system as recited in claim 14, wherein:

the life information obtainer obtains the life information of more than one consumable unit; and if the life information of at least one of the consumable units does not exceed the first predetermined value, the determiner makes the second decision to output an instruction to deliver a large-capacity toner cartridge containing a large amount of toner.

18. The replacement toner cartridge management system as recited in claim 13, wherein the transmitter of the replacement toner cartridge management apparatus outputs the delivery instruction to an order receiving server which the replacement toner cartridge management apparatus can access via a communication circuit.

19. A replacement toner cartridge management method implemented by a replacement toner cartridge management system provided with a replacement toner cartridge management apparatus and one or more than one image forming apparatus having one or more than one toner cartridge and one or more than one other consumable unit loaded thereon, which can access each other via a communication network, comprising:

the image forming apparatus's transmitting toner cartridge replacement information indicating the toner cartridge has been replaced or needs to be replaced with a new one; and the replacement toner cartridge management apparatus's:

receiving the toner cartridge replacement information;

obtaining life information of any of the consumable units other than the toner cartridge causing the received toner cartridge replacement information, the consumable units being replaced by a replacement consumable unit which will be delivered to the same delivery address as a replacement toner cartridge for the toner cartridge causing the toner cartridge replacement information;

determining a right type of replacement toner cartridge for the toner cartridge causing the toner cartridge replacement information, based on the obtained life information;

wherein the right types of toner cartridge are different depending on capacity; and outputting an instruction to deliver the right type of replacement toner cartridge;

wherein when the obtained life information exceeds a first predetermined value, the instruction is to deliver a small-capacity toner cartridge containing a small amount of toner as a replacement toner cartridge; when the obtained life information does not exceed the first predetermined value, the instruction is to deliver a large-capacity toner cartridge containing a large amount of toner as a replacement toner cartridge; or if the obtained life information exceeds a second predetermined value which is larger than the first predetermined value, the instruction is no delivery instruction.

20. A non-transitory computer-readable recording medium having a replacement toner cartridge management program stored thereon to make a computer of a replacement toner cartridge management apparatus execute:

receiving toner cartridge replacement information indicating a toner cartridge loaded on one or more than one image forming apparatus which the replacement toner cartridge management apparatus can access via a communication circuit has been replaced or needs to be replaced with a new one;

obtaining life information of a consumable unit other than the toner cartridge causing the received toner cartridge replacement information, the consumable unit being replaced by a replacement consumable unit which will be delivered to the same delivery address as a replacement toner cartridge for the toner cartridge causing the toner cartridge replacement information;

determining a right type of replacement toner cartridge for the toner cartridge causing the toner cartridge replacement information, based on the obtained life information;

wherein the right types of toner cartridge are different depending on capacity; and outputting an instruction to deliver the right type of replacement toner cartridge;

wherein when the obtained life information exceeds a first predetermined value, the instruction is to deliver a small-capacity toner cartridge containing a small amount of toner as a replacement toner cartridge; when the obtained life information does not exceeds the first predetermined value, the instruction is to deliver a large-capacity toner cartridge containing a large amount of toner as a replacement toner cartridge; or when the obtained life information exceeds a second predetermined value which is larger than the first predetermined value, the instruction is no delivery instruction.

21. A non-transitory computer-readable recording medium having a replacement toner cartridge management program stored thereon to make a computer of an image forming apparatus execute:

receiving toner cartridge replacement information indicating that a toner cartridge loaded on the image forming apparatus or on a different image forming apparatus which the image forming apparatus can access via a communication circuit has been replaced or needs to be replaced with a new one;

obtaining life information of a consumable unit other than the toner cartridge causing the received toner cartridge replacement information, the consumable unit being replaced by a replacement consumable unit which will be delivered to the same delivery address as a replacement toner cartridge for the toner cartridge causing the toner cartridge replacement information;

determining a right type of replacement toner cartridge for the toner cartridge causing the toner cartridge replacement information, based on the obtained life information;

wherein the right types of toner cartridge are different depending on capacity; and outputting an instruction to deliver the right type of replacement toner cartridge;

wherein when the obtained life information exceeds a first predetermined value, the instruction is to deliver a small-capacity toner cartridge containing a small amount of toner as a replacement toner cartridge; when the obtained life information does not exceeds the first predetermined value, the instruction is to deliver a large-capacity toner cartridge containing a large amount of toner as a replacement toner cartridge; or when the obtained life information exceeds a second predetermined value which is larger than the first predetermined value, the instruction is no delivery instruction.

* * * * *